US005868179A

United States Patent [19]

Hartsell, Jr.

[11] Patent Number: 5,868,179

[45] Date of Patent: Feb. 9, 1999

[54] PRECISION FUEL DISPENSER

[75] Inventor: Hal C. Hartsell, Jr., Kernersville, N.C.

[73] Assignee: Gilbarco Inc., Greensboro, N.C.

[21] Appl. No.: 811,397

[22] Filed: Mar. 4, 1997

[51] Int. Cl.[6] ..... B67D 5/04

[52] U.S. Cl. ..... 141/198; 141/94; 141/83; 141/95; 141/59; 141/128; 222/52; 222/71

[58] Field of Search ..... 141/59, 94, 95, 141/83, 128, 198; 222/52, 63, 71

[56] References Cited

U.S. PATENT DOCUMENTS

| | | | |
|---|---|---|---|
| 3,386,620 | 6/1968 | Smith | 141/128 |
| 3,536,109 | 10/1970 | Ginsburgh et al. | 141/98 |
| 3,586,070 | 6/1971 | Daniels, Jr. | 141/128 |
| 3,642,036 | 2/1972 | Ginsburgh et al. | 141/94 |
| 3,650,303 | 3/1972 | Chambers et al. | 141/1 |
| 3,662,924 | 5/1972 | Crandall et al. | 222/64 |
| 3,786,421 | 1/1974 | Wostl et al. | 340/149 |
| 4,263,945 | 4/1981 | Van Ness | 141/98 |
| 4,313,168 | 1/1982 | Stephens et al. | 364/465 |
| 4,345,146 | 8/1982 | Story et al. | 235/381 |
| 4,469,149 | 9/1984 | Walkey et al. | 141/94 |
| 4,490,798 | 12/1984 | Franks et al. | 364/550 |
| 4,532,511 | 7/1985 | Lemelson | 340/933 |
| 4,600,829 | 7/1986 | Walton | 235/439 |
| 4,714,925 | 12/1987 | Bartlett | 340/825.55 |
| 4,728,955 | 3/1988 | Hane | 342/140 |
| 4,760,533 | 7/1988 | Bydlon | 364/465 |
| 4,840,064 | 6/1989 | Fudim | 141/83 |
| 4,846,233 | 7/1989 | Fockens | 141/94 |
| 4,881,581 | 11/1989 | Hollerback | 141/113 |
| 4,887,578 | 12/1989 | Woodcock et al. | 123/519 |

(List continued on next page.)

FOREIGN PATENT DOCUMENTS

| | | |
|---|---|---|
| A 21858 | 3/1989 | Australia . |
| 0 349316 A1 | 1/1990 | European Pat. Off. . |
| 0 360 464 A2 | 3/1990 | European Pat. Off. . |
| 0 518 662 A1 | 12/1992 | European Pat. Off. . |
| 0 736 484 A2 | 10/1996 | European Pat. Off. . |
| 2600318 | 12/1987 | France . |
| 102768/2 | 8/1992 | Israel . |
| 94/4327 | 6/1994 | South Africa . |
| 2 222 714 | 3/1990 | United Kingdom . |
| 2 293 658 | 4/1996 | United Kingdom . |
| 94/05592 | 3/1994 | WIPO . |
| 94/06031 | 8/1994 | WIPO . |
| 95/14612 | 6/1995 | WIPO . |
| 95/32919 | 12/1995 | WIPO . |
| 96/28791 | 9/1996 | WIPO . |
| 96/39351 | 12/1996 | WIPO . |

*Primary Examiner*—J. Casimer Jacyna
*Attorney, Agent, or Firm*—Rhodes Coats & Bennett, L.L.P.

[57] ABSTRACT

The invention provides a fuel dispenser for a dispensing system having a receiver capable of receiving fueling parameters transmitted from the vehicle. The fueling parameters relate to information about tank size, ullage, maximum allowed fueling rates and maximum fueling rates as a function of ullage, among others. Based on these fueling parameters, the fuel dispenser controls the fueling operation to optimize fuel delivery and minimize fuel spillage. Control of the fueling operation may vary from simply adjusting the delivery rate to a maximum allowed by the vehicle to defining a fueling schedule for the entire fueling operation wherein the fueling schedule defines a fueling process which varies flow rates throughout the fueling operation as necessary to optimize fueling. Additionally, the dispenser may continuously adjust the maximum fueling rate throughout the fueling operation based upon a fueling parameter defining the maximum fueling rate as a function of ullage.

The dispenser may also control the fueling operation based on fueling parameters received from the vehicle in combination with fueling regulations mandated by various regulatory bodies. In such embodiments, the dispenser may optimize the fueling operation while abiding by both vehicular and regulatory limitations, such as maximum allowable delivery rates and predefined average fuel rates for all or various portions of the fueling operation.

66 Claims, 18 Drawing Sheets

U.S. PATENT DOCUMENTS

| | | | |
|---|---|---|---|
| 4,897,642 | 1/1990 | DiLullo et al. | 340/825.06 |
| 4,919,305 | 4/1990 | Podgers | 222/55 |
| 4,930,665 | 6/1990 | Devine | 222/71 |
| 4,934,419 | 6/1990 | Lamont et al. | 141/94 |
| 4,967,366 | 10/1990 | Kaehler | 364/479 |
| 5,025,253 | 6/1991 | DiLullo et al. | 340/825.06 |
| 5,040,577 | 8/1991 | Pope | 141/59 |
| 5,053,774 | 10/1991 | Schuermann et al. | 342/44 |
| 5,070,328 | 12/1991 | Fockens | 340/825.54 |
| 5,072,380 | 12/1991 | Randelman et al. | 364/406 |
| 5,086,389 | 2/1992 | Hassett et al. | 364/401 |
| 5,141,019 | 8/1992 | LeBlanc et al. | 141/198 |
| 5,156,198 | 10/1992 | Hall | 141/94 |
| 5,163,586 | 11/1992 | Zinsmeyer | 222/71 |
| 5,204,512 | 4/1993 | Ieki et al. | 235/382 |
| 5,204,819 | 4/1993 | Ryan | 364/465 |
| 5,238,034 | 8/1993 | Corfitsen | 141/94 |
| 5,249,612 | 10/1993 | Parks et al. | 141/219 |
| 5,249,707 | 10/1993 | Simpson et al. | 222/40 |
| 5,251,773 | 10/1993 | Bowles et al. | 220/86.2 |
| 5,257,720 | 11/1993 | Wulc et al. | 222/71 |
| 5,267,592 | 12/1993 | Kaplan et al. | 141/387 |
| 5,327,066 | 7/1994 | Smith | 320/2 |
| 5,327,945 | 7/1994 | Simpson et al. | 141/59 |
| 5,343,906 | 9/1994 | Tibbals, III | 141/83 |
| 5,359,522 | 10/1994 | Ryan | 364/465 |
| 5,363,889 | 11/1994 | Simpson et al. | 141/208 |
| 5,365,984 | 11/1994 | Simpson et al. | 141/387 |
| 5,383,500 | 1/1995 | Dwars et al. | 141/98 |
| 5,392,049 | 2/1995 | Gunnarsson | 342/42 |
| 5,393,195 | 2/1995 | Corfitsen | 414/749 |
| 5,414,427 | 5/1995 | Gunnarsson | 342/51 |
| 5,444,742 | 8/1995 | Grabow et al. | 375/267 |
| 5,485,520 | 1/1996 | Cahum et al. | 380/24 |
| 5,495,250 | 2/1996 | Ghaem et al. | 342/51 |
| 5,505,234 | 4/1996 | Simpson et al. | 141/206 |
| 5,507,325 | 4/1996 | Finlayson | 141/83 |
| 5,507,326 | 4/1996 | Cadman et al. | 141/198 |
| 5,541,835 | 7/1996 | Dextraze et al. | 364/401 |
| 5,552,789 | 9/1996 | Schuermann | 342/42 |
| 5,557,268 | 9/1996 | Hughes et al. | 340/933 |
| 5,605,182 | 2/1997 | Oberrecht et al. | 141/94 |
| 5,660,214 | 8/1997 | Pettesch | 141/198 |
| 5,673,732 | 10/1997 | Kenney et al. | 141/59 |

PRECISION FUEL DISPENSER

BACKGROUND OF THE INVENTION

The present invention relates generally to fuel dispensers and, more particularly, to fuel dispensers for precisely delivering and controlling the rate of fuel flow to a vehicle based upon information received from the vehicle during a fueling operation.

Federal regulations limit vehicle fueling to ten gallons per minute (GPM) in order to achieve legislated limits on the amount of spillage from vehicle fueling operations. See 58 Federal Register 16019. Conventional gasoline dispensers are restricted to a maximum delivery rate of 10 GPM in an effort to reduce fuel spit-back and spillage and the resultant exposure of fuel to customers and the environment. The current technology (i.e. prior to this invention) for restricting fuel delivery rate on gasoline dispensers is to install restrictive orifices at accessible points in the delivery system and/or various hose and nozzle configurations (known as hanging hardware,) accordingly.

The state of the art does not provide a way to optimize fuel delivery while abiding by the government regulations. Current fuel dispensers cannot maximize delivery rates and/or maintain an average fuel delivery rate of 10 GPM during a substantial portion of or throughout the fueling operation while minimizing spillage. Dispensers are limited because information relating to fuel tank ullage and maximum allowable delivery rates is unavailable. Additionally, current dispensers are unable to precisely control fuel delivery throughout the fueling operation. The dispenser cannot predict maximum vehicle fueling rates or the end of the fueling operation in order to precisely control fuel delivery during the fueling operation in order to maximize fueling rates while staying within regulated flow rate averages and minimizing spillage. Different vehicles have different fueling capabilities. Current dispensers are unable to recognize these differences to adjust their performance to optimize fueling. Many vehicles may be fueled at rates significantly higher than 10 GPM, without threat of spillage during most of the fueling operation. If a dispenser could determine the vehicle's fueling capability, fueling could occur at varying rates throughout the fueling operation to obtain an overall average of 10 GPM, without threat of spillage during most of the fueling operation. Thus, the fueling time and spillage could be minimized, while abiding by regulatory mandates.

The accuracy of restricted orifices and hanging hardware inherently suffers from fluctuations in system feed pressure. System feed pressure is affected by a number of variables including the number of active fueling positions, clogged fuel filters, kinked hoses and other deteriorating components along a fuel delivery path. The requisite restriction is dependent upon site specifics, such as, but not limited to, pumping device capacity, pipe diameter, pipe length, head height, hose diameter, hose length and nozzle type. These factors prevent effective factory presetting of desired fuel delivery rates. Moreover, orifices and hardware are subject to tampering, removal or substitution in an effort to defeat flow restrictions. When fuel pumps incorporating the current technology are checked for compliance with the regulations, the testing authority will check the highest flow delivery hose, typically the hose closest to the main turbine pump, with all other hoses inactive. Once adjustments are made to limit the high-flow hose to 10 GPM, the lower flow hoses will inherently deliver less than 10 GPM. The situation is exacerbated when multiple pumps are active. Under these situations, even the highest flow hose will often deliver significantly less than 10 GPM.

Conventional individual fuel dispensers are unable to optimize and control fueling in multi-dispenser systems. Additionally, the current technology cannot provide precise regulation of fuel delivery under varying dynamic changes affecting the fuel delivery rate by site, dispenser, user and other variables. For example, substantial changes in pressure within the fuel delivery system occur when other dispensers within the system turn on or off, or adjust fueling rates. Currently, these changes in pressure prevent precise fueling regulation and optimization. Furthermore, current fuel dispensers are unable to adequately control delivery rate overshoot and undershoot or provide sufficient system response times. Without such control, precisely controlling a fueling operation is virtually impossible.

Current dispensers are unable to precisely control the ramping up of the delivery rate to prevent an initial surge at the onset of fueling or the ramping down of the flow rate to quickly and efficiently reach pre-set sale values or quantities. Providing a fuel dispenser capable of precisely controlling the entire fueling operation based on fueling parameters received from a vehicle, particular to that vehicle, would enable a very smooth, quick and efficient fueling operation.

Although it is well-known in the art at this time to provide communications between a fuel delivery system and a vehicle, none of the existing dispensers are capable of precisely controlling a fueling operation to maximize fueling efficiency based on information received from the vehicle to be fueled. Many systems are available which are capable of recognizing a vehicle automatically and providing communications to and from the vehicle from a fuel dispenser to keep track of customer billing or automobile diagnostics. U.S. Pat. No. 5,072,380 to Randelman et al. and U.S. Pat. No. 5,557,268 to Hughes et al. are exemplary of these systems. U.S. Pat. Nos. 5,359,522 and 5,204,819 to Ryan disclose the use of two-way RF communication systems between a vehicle computer and a fuel dispenser computer. The communication systems provide automatic activation of the fuel delivery transaction, identification of the fluid container for security and billing purposes, automatic payment without use of an identification card and memorializing fluid delivery transactions. Also disclosed is a passive communication device which uses part of the energy transmitted from the fuel dispenser for power.

U.S. Pat. No. 5,383,500 to Dwars et al. discloses a system controlling the automatic refueling of vehicles in a manner allowing a customer to control the refueling procedure without exiting the vehicle. The communications system has the capability to start, monitor and finish the refueling procedure by transmitting and receiving data signals concerning the refueling procedure, such as signals which start the refueling procedure and interrupt that procedure. Communication between the vehicle and dispenser is possible through infrared, electromagnetic or acoustic wave transmission.

U.S. Pat. No. 5,343,906 to Tibbels, III discloses a communication system linking a computer of a vehicle to a computer of a fuel dispenser via an electrical or fiber optic connection. The system validates emissions by monitoring various emissions and diagnostic aspects of the vehicle, storing the information and communicating the information to a fuel dispenser. The system is capable of maintaining a record of the vehicle's fueling and emissions history.

U.S. Pat. No. 4,934,419 to LaMont et al. discloses a fuel management system where an on-board computer communicates with a fuel dispenser using fiber optics. The disclosure primarily focuses on the management of information used in the operation of fleet vehicles. U.S. Pat. No. 5,156,198 to Hall discloses the use of a common core transformer for communications between a vehicle's on-board computer and a fuel dispenser computer. The dispenser identifies the vehicle, the amount of fuel supplied to the vehicle, the vehicle mileage since the last fueling, the date of such fueling, and the time of actual use of the vehicle.

The above references are indicative of the state-of-the-art relating to communications between a vehicle and a fuel dispenser. Various communication methods are used in such communications and a variety of information ranging from fueling data and vehicle identification to a emission control and vehicle monitoring are disclosed. However, none of the references discuss or suggest controlling delivery rate to optimize fueling efficiency based on information received from the vehicle to be fueled. The applicants' invention provides this capability.

U.S. patent application Ser. No. 08/650,917, filed May 17, 1996 to Payne et al. discloses a precision fuel dispenser capable of controlling fuel delivery throughout the fueling operation. U.S. patent application Ser. No. 08/759,733, filed Dec. 6, 1996 to Hartsell, Jr. et al. discloses an intelligent fueling system capable of communicating with vehicles and determining their approximate location with respect to a fueling position. Both of these applications are owned by Gilbarco, Inc. of Greensboro, N.C. (the owner of the present application), and their disclosures are incorporated herein by reference. These applications provide additional disclosure of aspects relating to the current invention.

A precisely controlled fueling operation provides greater environmental protection capability by minimizing fuel spillage and spit-back. By reducing the initial surge at the onset of fueling and ramping down the flow rate towards the end of fueling, the amount of fuel spilled is greatly reduced. Furthermore, precisely controlling the fuel delivery allows precise flow rate control dependent upon a number of predetermined cut-offs during a predetermined period of time. Rapid, successive cut-offs indicate splash-back or excessive turbulence in the nozzle's fill neck, a condition likely to lead to fuel spills. Fuel dispensers are currently unable to control the fueling operation to effectively react to scenarios leading to fuel spills. If the dispenser could predict or determine the end of the fueling operation by the amount of fuel required to fill the vehicle's tank, the end of the fueling operation could be controlled accordingly without affecting the maximum fueling rates during the majority of the fueling operation. The applicants' invention provides such control to both minimize fuel spills and optimize fueling.

A further disadvantage of current fuel dispensers is the inability to automatically compensate for deteriorating components which nominally reduce flow. Components which often reduce flow include clogged fuel filters and kinked hoses. The applicants' invention allows fueling optimization even when the system components are not optimum. For example, as the fuel filter fills with debris, the flow control signal to the system fuel pump is increased in an amount to precisely compensate for any flow rate loss.

Thus, there remains a need for a new and improved fuel dispenser capable of optimizing fuel flow rate per regulatory agency mandate while maximizing site throughput under varying dynamic conditions based upon information received from the vehicle being fueled. A need remains for a fuel dispenser capable of receiving fueling parameters, such as tank size, ullage, and maximum fueling rate as a function of ullage from a vehicle in order to control or adjust the delivery rate of fuel to the maximum that the vehicle being fueled can accept without causing excessive spillage. A need not only exists for a fuel dispenser capable of instantaneously adjusting the fuel delivery rate to maximize fueling, but also to control the delivery rate throughout the fueling operation to optimize fueling efficiency within the confines of regulatory mandates and dispenser or vehicle limitations. A further need exists for a fuel dispenser capable of determining a fueling operation function which determines the various fueling rates throughout the fueling operation based on fueling parameters received from the vehicle to be fueled. A need exists for a fuel dispenser capable of delivering fuel at precise flow rates independent of site variations and capable of being manufactured in a manner requiring no field modifications or calibrations.

SUMMARY OF THE INVENTION

The present invention is directed to a precision fuel dispenser capable of precisely controlling the rate of fuel flow to a vehicle during a fueling operation based on information received from the vehicle being fueled. The invention provides a fuel dispenser for a dispensing system having a receiver capable of receiving fueling parameters transmitted from the vehicle. The fueling parameters may relate to information about tank size, amount of fuel remaining, ullage, maximum allowed fueling rates and maximum fueling rates as a function of ullage, among others. Not all of these parameters are necessary in every case. Based on the received fueling parameters, the fuel dispenser controls the fueling operation to optimize fuel delivery and minimize fuel spillage. Control of the fueling operation may vary from simply adjusting the delivery rate to a maximum allowed by the vehicle to defining a fueling schedule for the entire fueling operation wherein the fueling schedule defines a fueling process which varies flow rates throughout the fueling operation as necessary to optimize fueling. Additionally, the dispenser may continuously adjust the maximum fueling rate throughout the fueling operation based upon fueling parameters defining the maximum fueling rate as a function of ullage.

The dispenser may also control the fueling operation based on fueling parameters received from the vehicle in combination with fueling regulations mandated by various regulatory bodies. In such embodiments, the dispenser may optimize the fueling operation while abiding by both vehicular and regulatory limitations, such as maximum allowable delivery rates and predefined average fuel rates for all or various portions of the fueling operation.

In particular, the nominal rate of the regulatory mandate may be periodically temporarily exceeded while maintaining the regulated average. This provides a significant advantage with multiple dispenser systems which often fuel well under acceptable flow rates due to pressure losses associated with operating multiple pumps. Similarly, the control system may control the rate of flow in the delivery path to provide a predetermined average rate of flow during most of the fueling operation while staying within vehicle and regulatory limitations. The control system may control the rate of flow in the delivery path to provide a predetermined rate of flow under varying dynamic conditions. These conditions may include pressure changes and component failures or deterioration. Even under such diverse conditions, the invention can optimize fueling. Similarly, the control system may control the rate of flow in the delivery path to provide a predetermined average rate of flow under varying dynamic conditions. A related aspect of the control systems is to control the rate of flow in the delivery path to compensate for deteriorating components or obstructions which reduce flow.

The control system reduces fuel spillage and protects the environment by controlling the rate of flow in the delivery path to provide a reduced rate of flow near the end of the fueling operation or after one or more premature automatic shut-offs. Premature shut-offs indicate excessive turbulence in the fill neck which increases the risk of spilling fuel.

These and other aspects of the present invention will become apparent to those skilled in the art after a reading of the following description of the preferred embodiment when considered with the drawings.

DESCRIPTION OF THE PREFERRED EMBODIMENT

Figure 1:
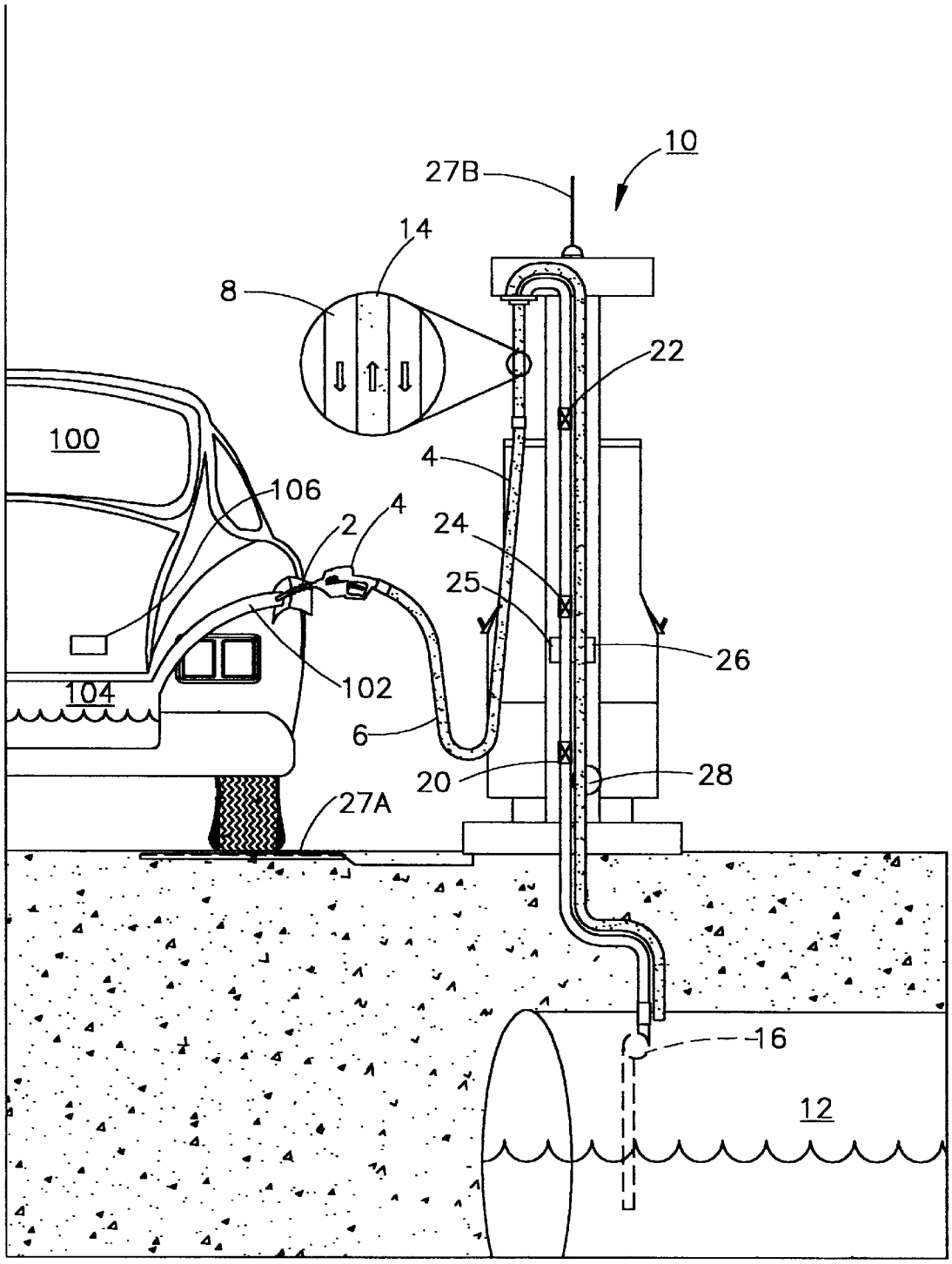
FIG. 1 is an elevational and partial sectional view of a typical gasoline dispenser having a vapor recovery system according to an embodiment of the present invention.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, an automobile 100 is shown being fueled from a gasoline dispenser 10. A spout 2 of nozzle 4 is shown inserted into a filler pipe 102 of a fuel tank 104 during the refueling of the automobile 100.

A fuel delivery hose 6 having vapor recovery capability is connected at one end to the nozzle 4, and at its other end to the fuel dispenser 10. As shown by the cutaway view of the interior of the fuel delivery hose 6, a fuel delivery passageway 8 is formed within the fuel delivery hose 6 for distributing gasoline pumped from an underground storage tank 12 to the nozzle 2. Gasoline is typically pumped by a delivery pump system 16 located within tank 12. The fuel delivery passageway 8 is typically annular within the delivery hose 6 and tubular from within the fluid dispenser 10 to the tank 12. The fuel delivery hose 6 typically includes a tubular vapor recovery passageway 14 for transferring fuel vapors expelled from the vehicle's fuel tank 104 to the underground storage tank 12 during the refueling of the vehicle 100.

A vapor recovery pump 28 provides a vacuum in the vapor recovery passageway 14 for removing fuel vapor during a refueling operation. The vapor recovery system using the pump 28 may be any suitable system such as those shown in U.S. Patent No. 5,040,577 to Pope, U.S. Pat. No. 5,195,564 to Spalding, U.S. Pat. No. 5,333,655 to Bergamini et al., or U.S. Pat. No. 3,016,928 to Brandt. The invention is equally useful on dispensers that are not vapor recovery dispensers.

The fuel delivery passageway 8 typically includes a control valve 22, a positive displacement flow meter 24 and fuel filter 20. The fuel dispenser 10 also includes a control system 26 operatively associated with the control valve 22, flow meter 24 and the fuel pump 16. In the preferred embodiment, the control valve 22 acts as a flow modulator, and the flow meter 24 acts as a fuel flow transducer.

A transmitter 106 in vehicle 100 is used to transmit fueling parameters or other information relating to the vehicle 100 to a receiver 25 associated with the control system 26 of the fuel dispenser 10. In the preferred embodiment, an RF communication link is established between the transmitter 106 of the vehicle 100 and the transmitter 25 of the fuel dispenser 10. One or more antennas 27A, 27B may be used to facilitate reception of the fueling parameters and other information sent from the vehicle 100. Although this specification focuses primarily on sending information in one direction from the vehicle 100 to the dispenser 10, bi-directional communication between the vehicle 100 and dispenser 10 may be preferable in certain embodiments. For bi-directional communications, transceivers (including transponders) in the vehicle 100 and in fuel dispenser 10 are preferred. The dispenser may transmit various types of information to the vehicle. Transaction information may include amount of sale, amount of fuel dispensed or other billing data. The communications link may also provide for payment of fuel delivered and products or services purchased at the dispenser or store.

Additionally, any type of communication link between the vehicle 100 and dispenser 10 is acceptable. For example, infrared, optical, acoustic, electromagnetic or electrical communications may be used. The embodiment discussed in detail herein provides an RF communication link between the transmitter 106 of the vehicle 100 and the receiver 25 of the fuel dispenser 10.

The control system 26 of fuel dispenser 10 is adapted to receive fueling parameters communicated from the vehicle 100, such as tank size, ullage, amount of fuel remaining in tank, maximum fueling rate and maximum fueling rate as function of ullage, vehicle type, vehicle identification, fuel type, diagnostics, onboard vapor recovery capability, among others, and control the fuel delivery rate in order to optimize the fueling operation. In one embodiment, the controller will simply determine the maximum allowable fuel delivery rate based on fueling parameters received from the vehicle 100 and adjust the delivery rate of fuel to the maximum that the vehicle can accept without causing excessive spillage. The received vehicle fueling parameters may simply provide a single, maximum fuel delivery rate, not to be exceeded during any portion of the fueling operation regardless of ullage. If the vehicle transmits a parameter relating to the maximum fueling rate as a function of ullage, then the controller 26 may continuously adjust the fuel delivery rate to the maximum allowable based on the corresponding ullage value.

Controlling a fueling operation based on fueling parameters received from the vehicle 100 provides significant flexibility in controlling and defining a fueling operation. The vehicle's ullage information allows the controller 26 to determine the amount of fuel required to fill the tank; therefore, allowing the control system 26 to accurately determine or predict the end of the fueling operation. When the control system 26 can predict the end of the fueling operation, fuel can be delivered at higher rates, for longer periods of time, without spilling fuel. For example, once the amount of fuel needed to fill the tank is determined, the control system 26 can determine precisely when to reduce the flow rate to prevent spilling fuel as the tank 104 reaches capacity.

The control system 26 may also control ramping up the fuel rate at the beginning of the fueling operation in order to minimize any initial surge created by the on-rush of fuel. Additionally, the maximum flow rate throughout the fueling operation is controllable based on any number of factors, alone or in combination, such as: 1) maximum allowable fuel delivery rates set by the vehicle, 2) maximum allowable fuel delivery rates set by government regulations, and/or 3) maximum allowable fuel delivery rate as a function of fuel tank ullage. Furthermore, these maximum allowable fuel delivery rates can be either instantaneous or an average taken over a portion or all of the fueling operation. If a regulatory agency set a maximum allowable average fuel delivery rate of 10 GPM, the control system 26 could exceed 10 GPM during a portion of the fueling operation in order to provide an overall 10 GPM average fuel delivery rate throughout the entire fueling operation. Such averages may also be obtained during any select portion of the fueling operation. These averages are obtained in conjunction with staying within any of the maximum allowable fueling delivery rates defined by the vehicle, government or other limiting source. Thus, applicants' invention allows precise control over the fueling operation while taking into consideration fueling parameters of the vehicle and/or regulatory mandates in order to optimize fueling efficiencies and minimize fuel spillage.

Preferably, fuel delivery at the beginning and end of the fueling operation is controlled to reduce fuel surge and spillage. At the beginning of the fueling operation, the flow rate is ramped up in a manner which provides for a smooth transition from a zero flow rate to the desired fueling rate. Likewise, the fueling rate may be controlled in a manner providing a smooth transition from the desired delivery rate to a zero delivery rate in order to reduce the possibility of spilling fuel at the end of the fueling operation.

Figure 2:
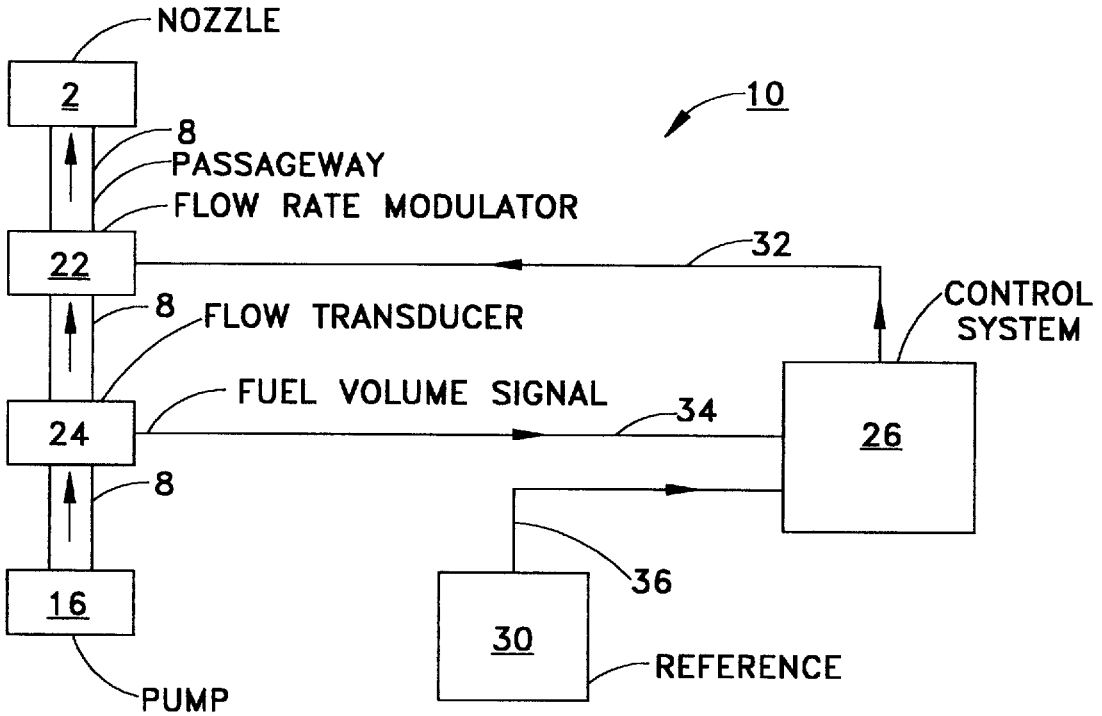
FIG. 2 is a block diagram illustrating a fuel dispenser's flow control system constructed according to an embodiment of the present invention.

Turning now to FIG. 2, the preferred embodiment employs a fuel flow transducer 24 which produces a fuel volume signal 34 by generating a digital transition for a given specific volume through the fuel flow transducer 24. The output of the fuel flow transducer 24 is fed to the control system 26. The control system 26 measures the period between the transitions of the fuel volume signal 34 to yield a numerical value inversely proportional to a flow rate through the fuel passageway 8. Alternatively, the control system 26 may count transitions in the fuel volume signal 34 over a fixed period of time to yield a numerical value directly proportional to the flow rate of fuel through the fuel passageway 8. With either method, the flow rate is compared with a desired reference value by the control system 26 to obtain system error. The reference signal may be stored or calculated by the control system 26 or read from a set delivery rate reference source 30 within or associated with the control system 26 via a delivery rate reference signal 36. The reference value may be a numerical coefficient calculated by the control system 26 or derived from an external source such as an oscillator whose input is processed in similar fashion to the flow measurement device. The reference may represent the instantaneous maximum allowable delivery rate, a value representative of the desired system delivery rate or a value representing a flow-rate-dependent result.

Figure 3:
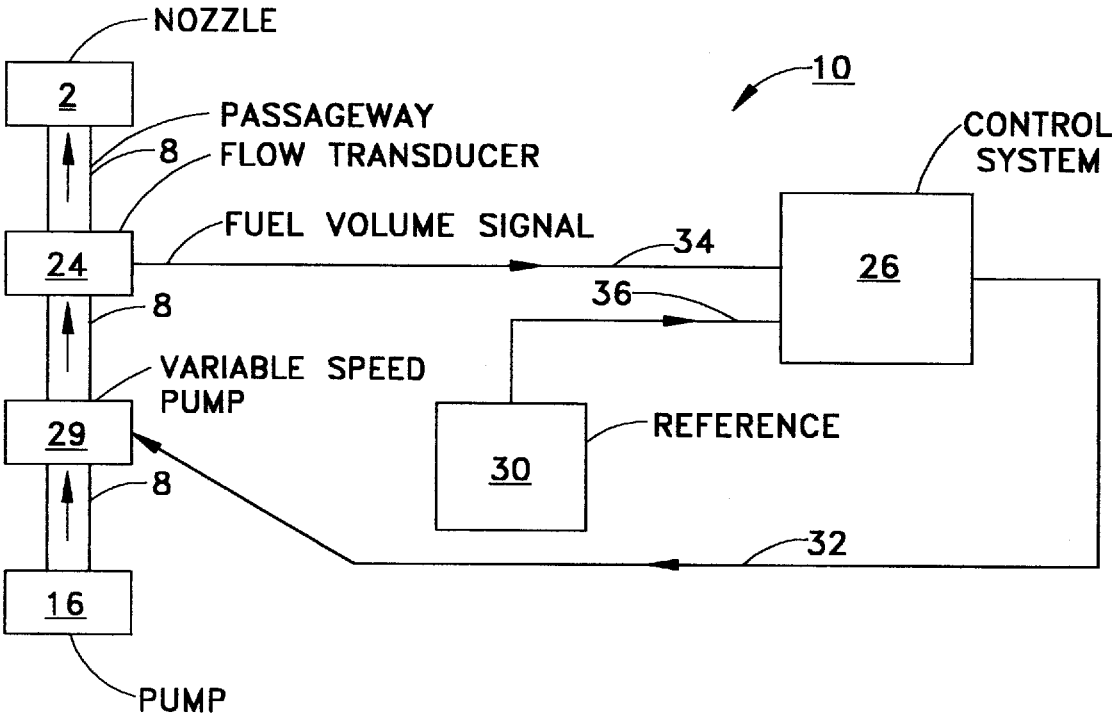
FIG. 3 is a block diagram illustrating an alternative embodiment of a fuel dispenser's flow control system constructed according to the present invention.

The result of the comparison of the flow rate value and reference value represents an error value which is a scalar of the difference between the desired and actual fuel delivery rate. The error value is inputted into a conventional proportional-integral-derivative (PID) algorithm by the control system 26 to derive a forcing function 32 which is outputted to a flow rate modulator 22. The flow rate modulator 22 may include an electromechanically driven valve or any suitable controllable flow restricting device. The flow rate modulator 22 is preferably actuated in proper phase with a servo loop. Alternatively, the forcing function may modulate the pumping rate of variable speed fuel pump 28 as shown in FIG. 3.

Those of ordinary skill in the art are able to program control system 26 with a suitable PID algorithm. The preferred embodiments use a PID feedback control system with greater than unity gain. The PID feedback control system is easily implemented and the PID coefficients are chosen to compensate for any mechanical or electrical time constants and delays present in the fuel delivery system of the fuel dispenser 10, thereby effecting improved regulative response to dynamic changes imposed by site, dispenser, vehicle, user or other variables which would otherwise affect unregulated fuel delivery rates.

The feedback control system may be modified and the regulatory functions still effectively implemented by deleting the derivative term at the compromise of delivery rate overshoot, undershoot or system response time. Alternatively, a unity or less than unity gain feedback control system may be implemented by modulating the flow rate modulator 22 or variable speed pump 28 at a rate equal to or less than the sum of mechanical and electrical system delays at greater compromise of delivery rate overshoot, undershoot or system response time. Those of ordinary skill in the art will recognize that other feedback systems of lesser or greater complexity and of lesser or greater performance may be implemented to achieve a desired fuel delivery rate. However, the preferred embodiment will include a reference signal or value representative of the desired delivery rate, a feedback signal or value comprising or representing the actual delivery rate, a control system that accepts the reference and feedback signals to derive a forcing function, and a flow controlling device receiving the forcing function capable of modulating the fuel delivery rate. Systems requiring a lesser degree of accuracy or having a very precise and controllable flow rate modulator may not require feedback.

Applicants' invention provides a cost effective method to achieve product flow control in a gasoline dispenser by using existing electronics and hydraulic components, and modifying the control software with input from the receiver 25. Current gasoline dispensers have a controller 26 for controlling all functions of the dispenser, a positive displacement flow meter 24, and one or more control valves 22 for turning on or off the product flow. The controller can be modified to monitor the signals 34 from the flow meter 24, calculate an actual flow rate from signals 34 and send modulating signals 32 to control valve 22 to control the flow rate to desired levels, such as 10 GPM.

In operation, the control system 26 (for either FIG. 2 or FIG. 3) provides a variety of flow rate control functions to achieve a flow-rate-dependent result based on fueling parameters received from the vehicle 100 and/or regulatory mandates. The control system may be configured to control the flow rate according to a reference flow rate. As discussed above, the reference may come from within the control system 26 or be received from the dispenser's receiver 25. For the discussion herein, the reference 30 is calculated by the control system 26 based on information received from the vehicle 100 and/or regulatory mandates and represents a desired instantaneous flow rate. The reference may remain constant or continuously vary as desired to effect desired instantaneous flow rates or a defined fueling schedule.

The determination of the reference and any fueling schedule based on vehicle fueling parameters is described in detail below in association with FIGS. 15 through 19. A description of the various types of delivery flow rate control operations are described immediately below in association with FIGS. 4–14. The present invention is capable of combining various types of delivery control to optimize fueling during a fueling operation.

Figure 4:
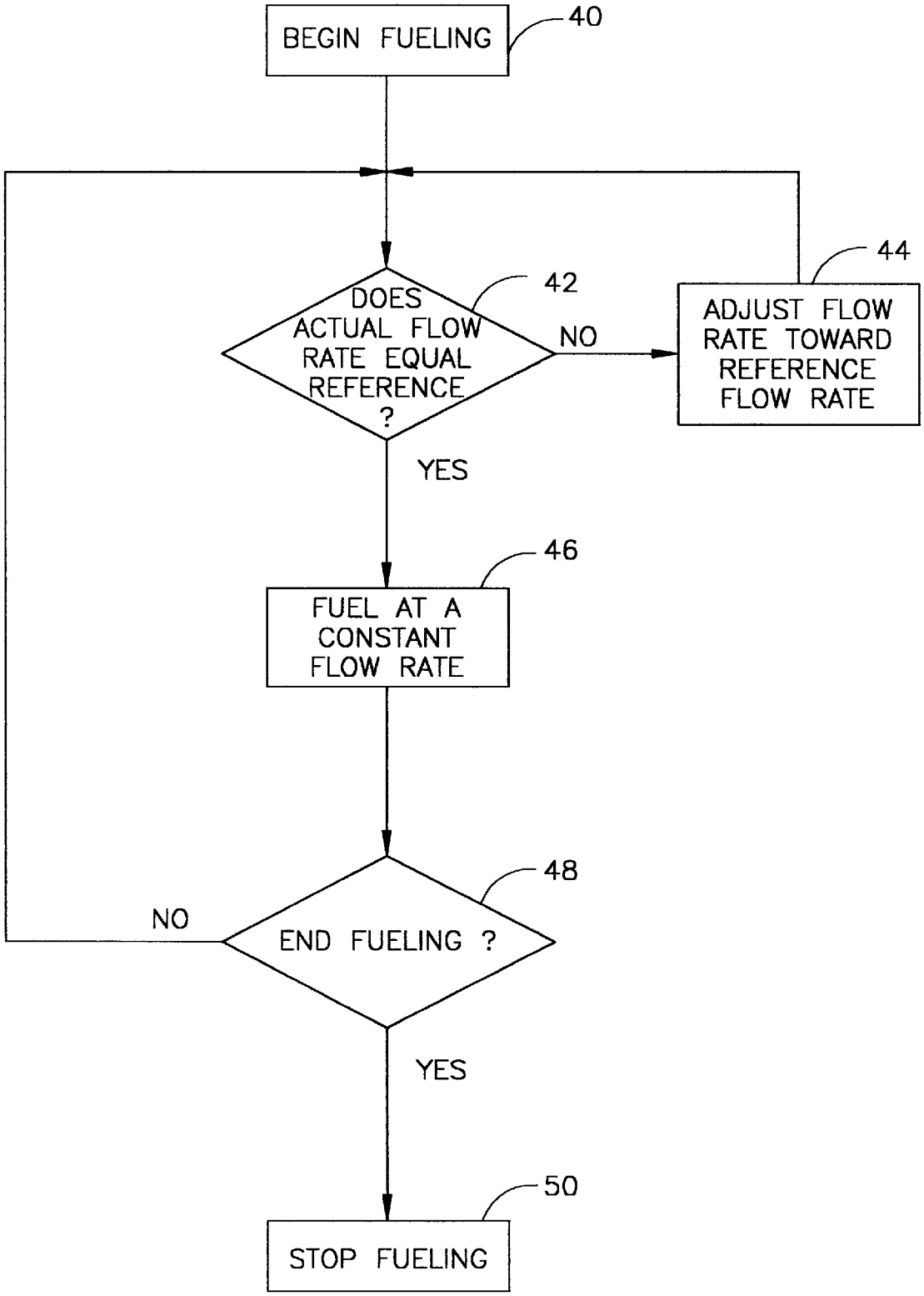
FIG. 4 is a flow chart depicting a control process for controlling the flow rate with respect to a reference flow rate according to one embodiment of the current invention.

FIG. 4 depicts a basic control outline for a typical fueling operation to obtain a desired reference flow rate. The reference may be constant or varied, as desired, throughout the fueling operation. Block 40 indicates the beginning of a fueling operation During the fueling operation, the controller determines the desired flow rate based on fueling parameters from the vehicle and/or regulatory mandates and whether the actual flow rate is equal to the reference or desired flow rate at decision block 42. If the rates are not equal, the flow rate is adjusted toward the reference or desired flow rate at block 44. Once the flow rate is adjusted at block 44, the controller returns to decision 42 to determine whether the actual and reference flow rates are equal. The flow rate is continually adjusted until the actual and reference flow rates are equal. Once the reference flow rate is achieved, the controller will deliver fuel at a constant flow rate at block 46. The controller 26 will check to see if the fueling operation is at an end at decision block 48. If the fueling operation is at an end, the controller 26 will stop fueling at block 50. If the fueling operation is not at an end, the controller 26 returns to decision block 42 to determine if the actual and reference or desired flow rates are equal. The control system will constantly adjust the flow rate to match the desired reference. The process is repeated until fueling is stopped.

Figure 5:
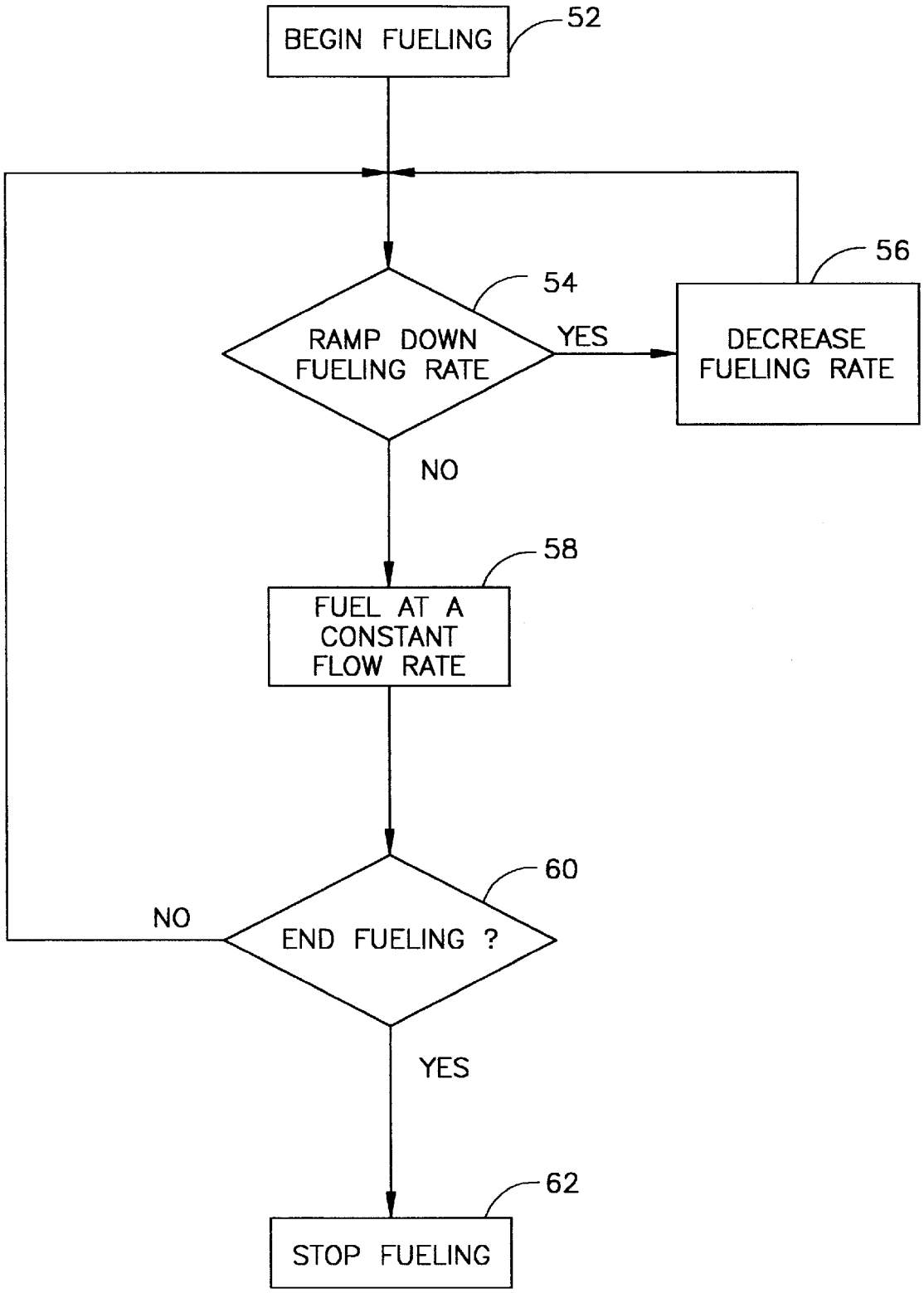
FIG. 5 is a flow chart depicting a control process for ramping down the fueling rate according to one embodiment of the current invention.

FIG. 5 is a flow chart setting out the basic control process for ramping down the fueling rate near the end of a fueling operation. The fueling operation begins at block 52. The controller 26 determines whether to ramp down the fueling rate at decision block 4. The fueling rate is decreased accordingly at block 56, if necessary. Once the fueling rate is decreased, the control system 26 returns to decision block 54. When the fueling rate does not require ramping down, the control system 26 causes fuel to be delivered at a constant rate at block 58. The control system 26 next checks for an end to the fueling operation at decision block 60. If the fueling operation is at an end, the controller 26 stops fueling at block 62. If the fueling operation is not at an end, the control system 26 returns to decision block 54 and reiterates the process. Those of ordinary skill in the art will understand that the terms ramp or ramping will include not only constant and variable flow rate changes, but also abrupt step changes in flow rates. Ramping down the flow rate may be used to slow the rate of fueling for pre-set sales, assist the customer in smoothly ending the fueling operation, or adjust the flow rate to a lower desired or reference flow rate in order to optimize fueling and minimize spillage.

Figure 6:
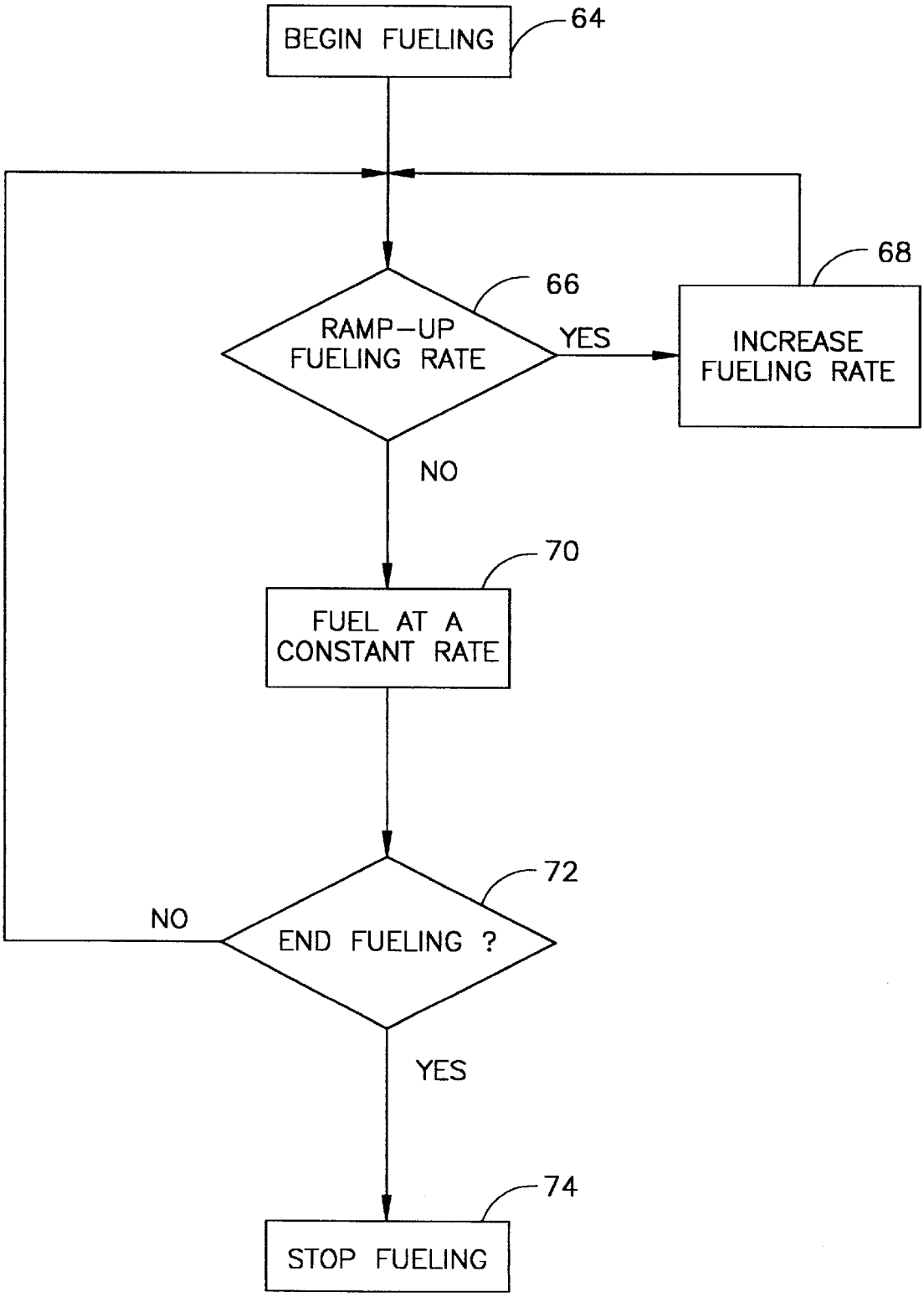
FIG. 6 is a flow chart depicting a control process for ramping up the fueling rate according to one embodiment of the current invention.

Likewise, the system may ramp up the flow rate from a reduced value to mitigate the initial surge at the onset of fueling to reduce fuel spillage or to increase the fueling rate to a desired or reference level. FIG. 6 depicts a flow chart for ramping up the flow rate. The fueling operation begins at block 64. During the fueling operation, the control system 26 determines whether it is necessary to ramp up the fueling rate at decision block 66. If the fueling rate needs increased, the control system 26 increases the fueling rate at block 68 and returns to decision block 66 to determine if a further increase is necessary. When the fueling rate does not require an increase, the control system 26 causes the delivery of fuel at a constant rate at block 70. The control system 26 determines whether the fueling operation is at an end at decision block 72. If the fueling operation is at an end, fueling is stopped at block 74. If the fueling operation is not at an end, the control system 26 returns to decision block 66 to reiterate the process.

Figure 7:
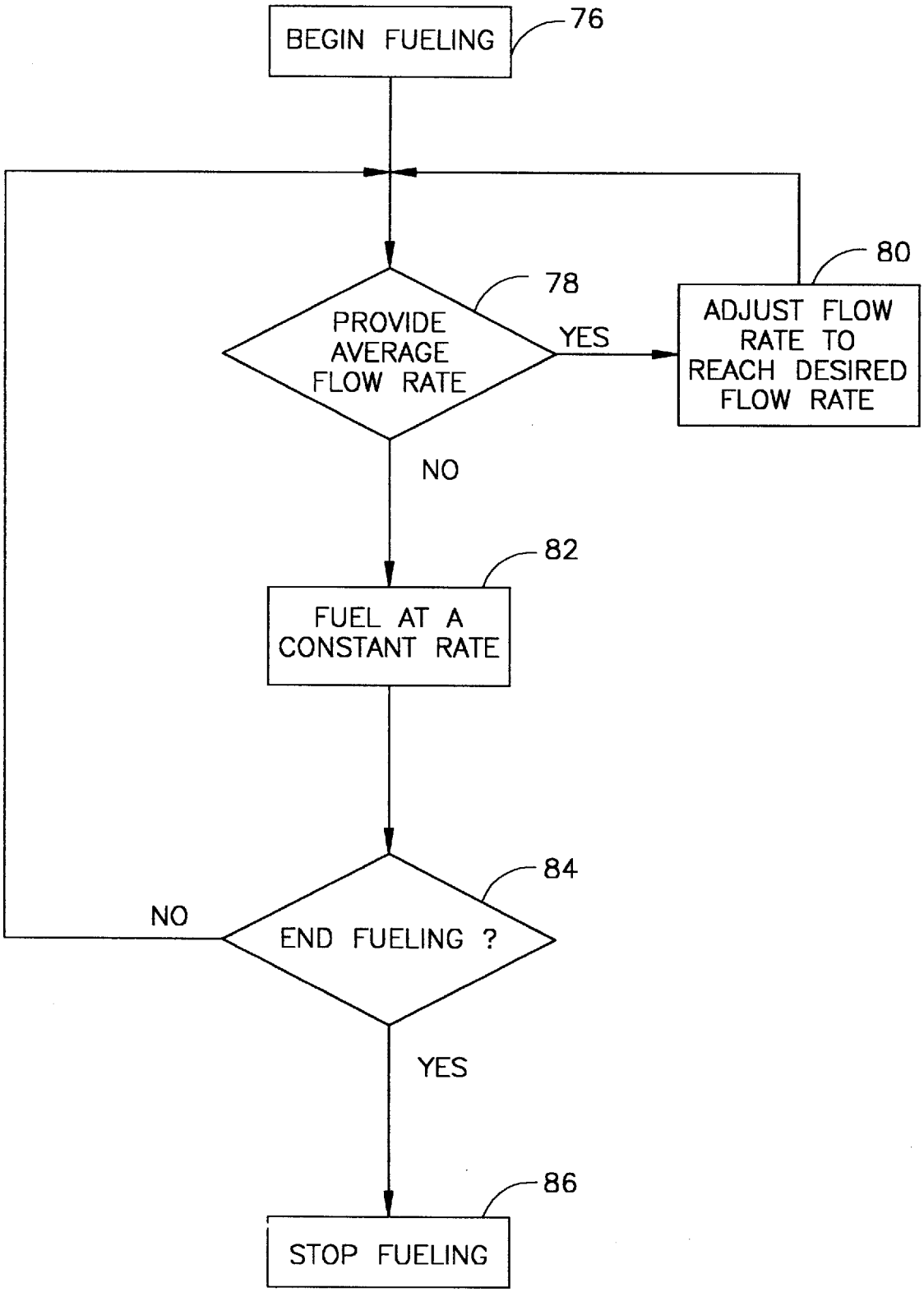
FIG. 7 is a flow chart depicting a control process for providing an average flow rate according to one embodiment of the current invention.

FIG. 7 provides a flow chart outlining a basic control process for providing a desired average flow rate during a portion of the fueling operation. The fueling operation begins at block 76. The control system determines whether or not to provide a desired average flow rate at decision block 78. If a desired average flow rate is required, the flow rate is adjusted by adjusting the reference in a manner calculated to reach the desired average flow rate at block 80. Providing an average flow rate allows the controller to deliver fuel at an average flow rate throughout any portion of the fueling operation. For example, if the average fueling rate has to be 10 GPM or less during all or part of the fueling operation, the dispenser may deliver fuel significantly above 10 GPM to compensate for the lower delivery rates during the beginning and/or end of the fueling operation or limitations provided by the vehicle or regulatory mandate. This feature achieves two major goals: first, a station operator improves customer throughput and second, customers receive fuel in a faster and safer manner. Such control is currently unavailable in the industry.

Once the average flow rate is achieved, the control system causes fueling at a constant rate at block 82. The control system determines whether the fueling operation is at an end at decision block 84. If the fueling operation is at an end, fueling is stopped at block 86. If the fueling operation is not at an end, the control system 26 returns to decision block 78 to further check and/or adjust the fueling rate to provide the desired average flow rate. The control system 26 may also control the rate of flow in the delivery path to provide a predetermined average rate of flow during various portions of or the entire fueling operation.

Figure 8:
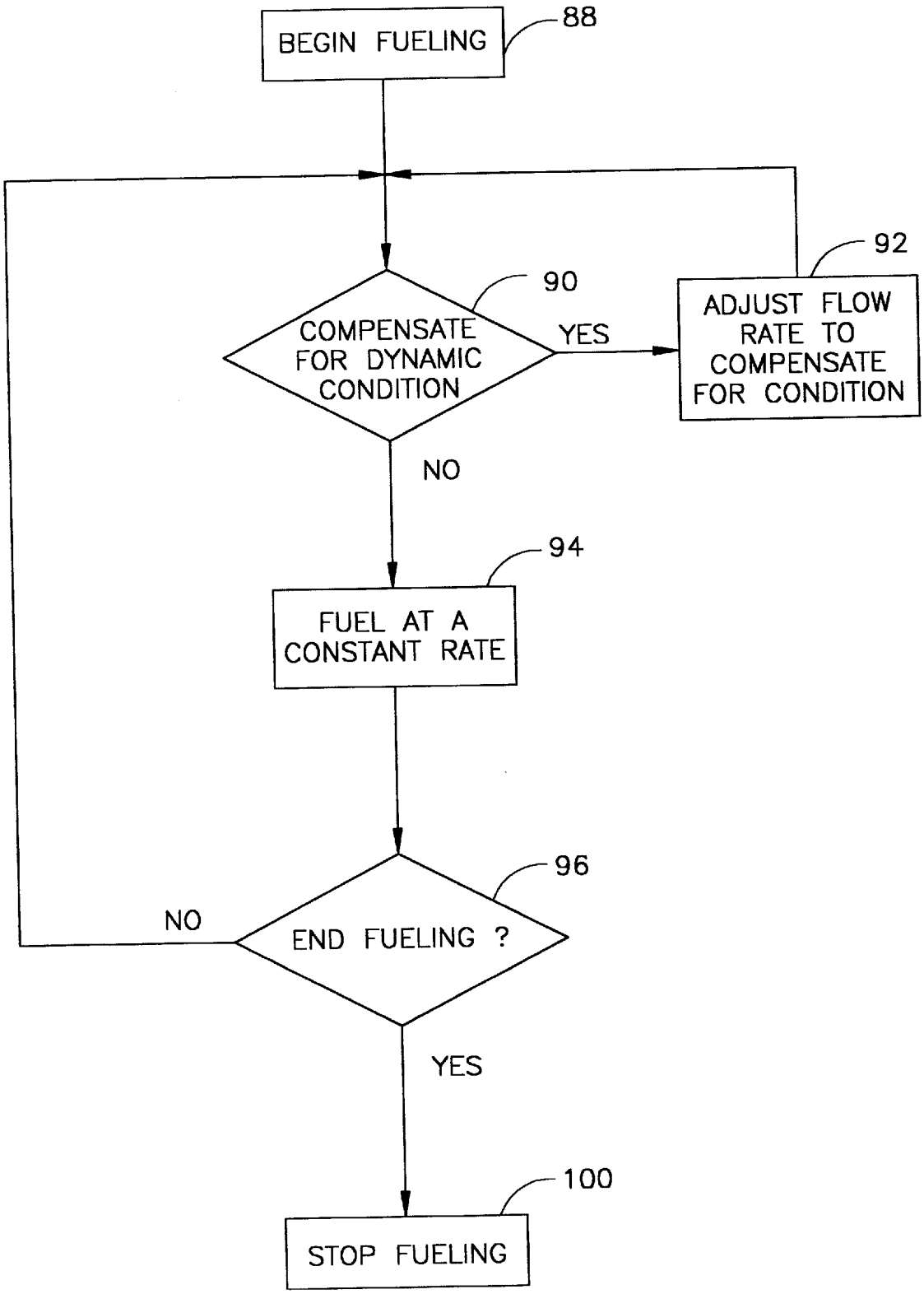
FIG. 8 is a flow chart depicting a control process for compensating for dynamic conditions according to one embodiment of the current invention.

FIG. 8 is a flow chart depicting a control process similar to that of FIG. 7. FIG. 8 provides a control process capable of compensating for dynamic changes in the fueling operation. The cause of these dynamic changes are often due to pressure changes in the fuel delivery system when multiple dispensers are turned on or off during the fueling operation, or a customer manually or accidentally adjusts the fueling rate or causes a premature cut-off. Current technology does not allow the dispenser to recover and continue to deliver fuel at a high average delivery rate. Prior systems are restricted to delivering fuel at the maximum flow rate allowed by the mechanical flow restrictors. In most cases, reduced system feed pressure prevents fueling at rates equal to the mechanical flow restrictors' maximum allowable flow rate.

The applicants' invention overcomes the inherent limitations of the mechanical restrictors by allowing fuel delivery rates to instantaneously and periodically rise above the average flow rates set by governmental regulations to provide an average flow rate meeting these regulations.

The fueling operation begins at block 88. The control system 26 determines whether there is a need to compensate for a dynamic change occurring during the fueling operation at decision block 90. If such a change is necessary, the control system 26 adjusts the flow rate to compensate for the condition at block 92 and returns to decision block 90 in an iterative manner. If the control system does not need to compensate for a dynamic condition, the fueling rate is held constant at block 94. The control system 26 determines whether the fueling operation is at an end at decision block 96. If the fueling operation is at an end, the control system 26 stops fueling at block 100. If the fueling operation is not at an end, the control system 26 returns to decision block 90 to determine whether the fueling rate requires further compensation.

Figure 9:
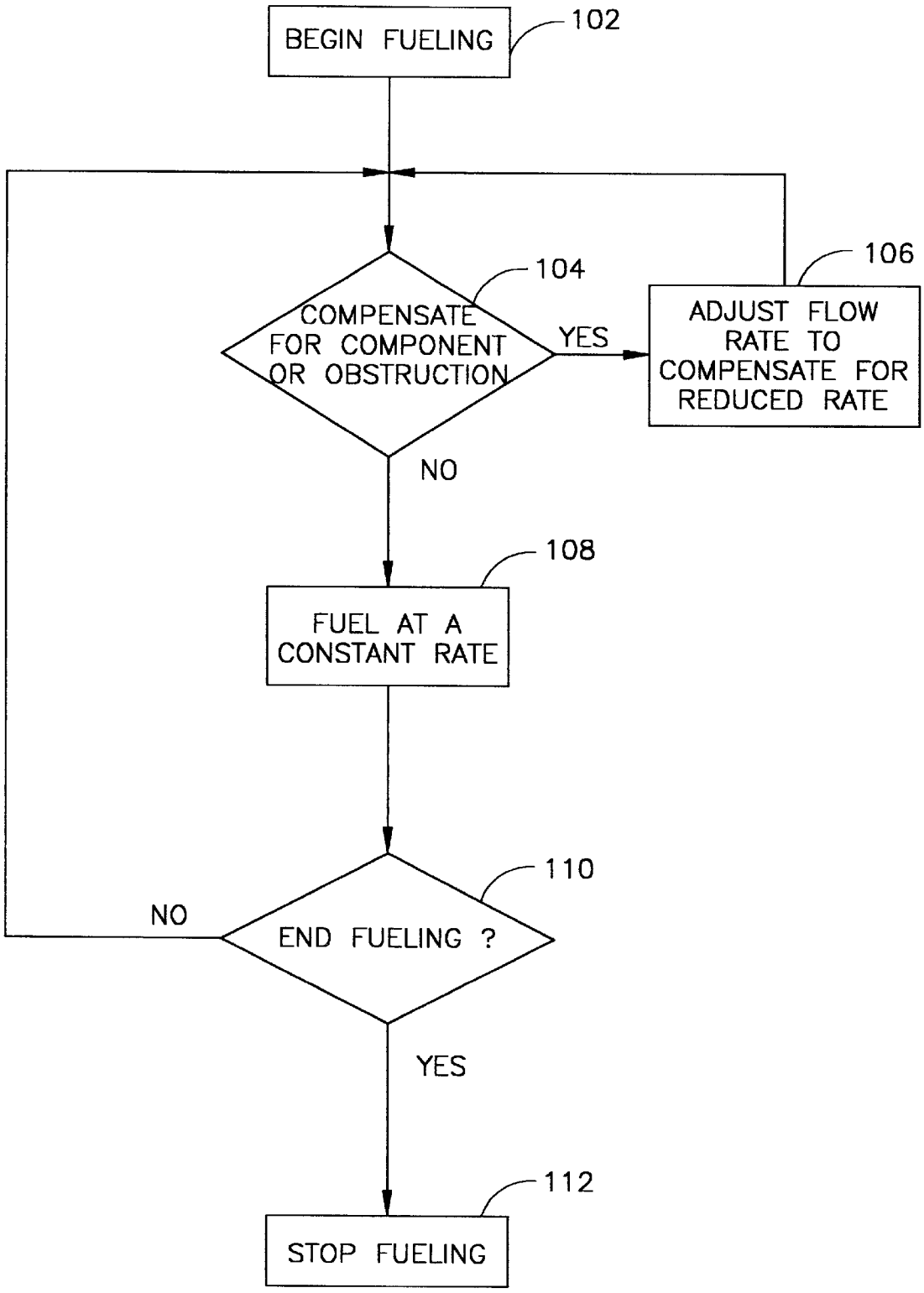
FIG. 9 is a flow chart depicting a control process for compensating for component deterioration or fuel passageway obstruction according to one embodiment of the current invention.

FIG. 9 depicts a flow chart outlining a control process for compensating delivery rates for deteriorating components which nominally reduce flow, such as fuel filters and kinked hoses, or other obstructions within the fuel passageway 8. Currently available fuel dispenser systems are unable to utilize excess site delivery capacity to automatically compensate for conditions negatively affecting flow.

Typically, additional restrictions simply further reduce flow rates substantially below allowed delivery rates. The current invention overcomes the limitations of the prior art by eliminating the need for mechanically restrictive orifices and utilizing a control valve 22. Many dispensers already include such a valve. When deteriorating components or passageway obstructions reduce flow rates, the current invention can use excess delivery capacity in conjunction with the control valve 22 in an effort to compensate for additional restrictions.

The fueling operation begins at block 102. The control system 26 determines whether or not to compensate for component deterioration or other obstructions unduly limiting delivery rates at decision block 104. If compensation is required, the control system adjusts the flow rate in an effort to compensate for the reduced flow at block 106 and returns to decision block 104 in an iterative manner. Once compensation is complete, the control system 26 causes fueling at a constant rate at block 108. The control system 26 next determines whether the fueling operation is at an end at decision block 110. If the fueling operation is at an end, fueling is stopped at block 112. If the fueling operation is not at an end, the control system 26 returns to decision block 104 in an iterative manner.

Figure 10:
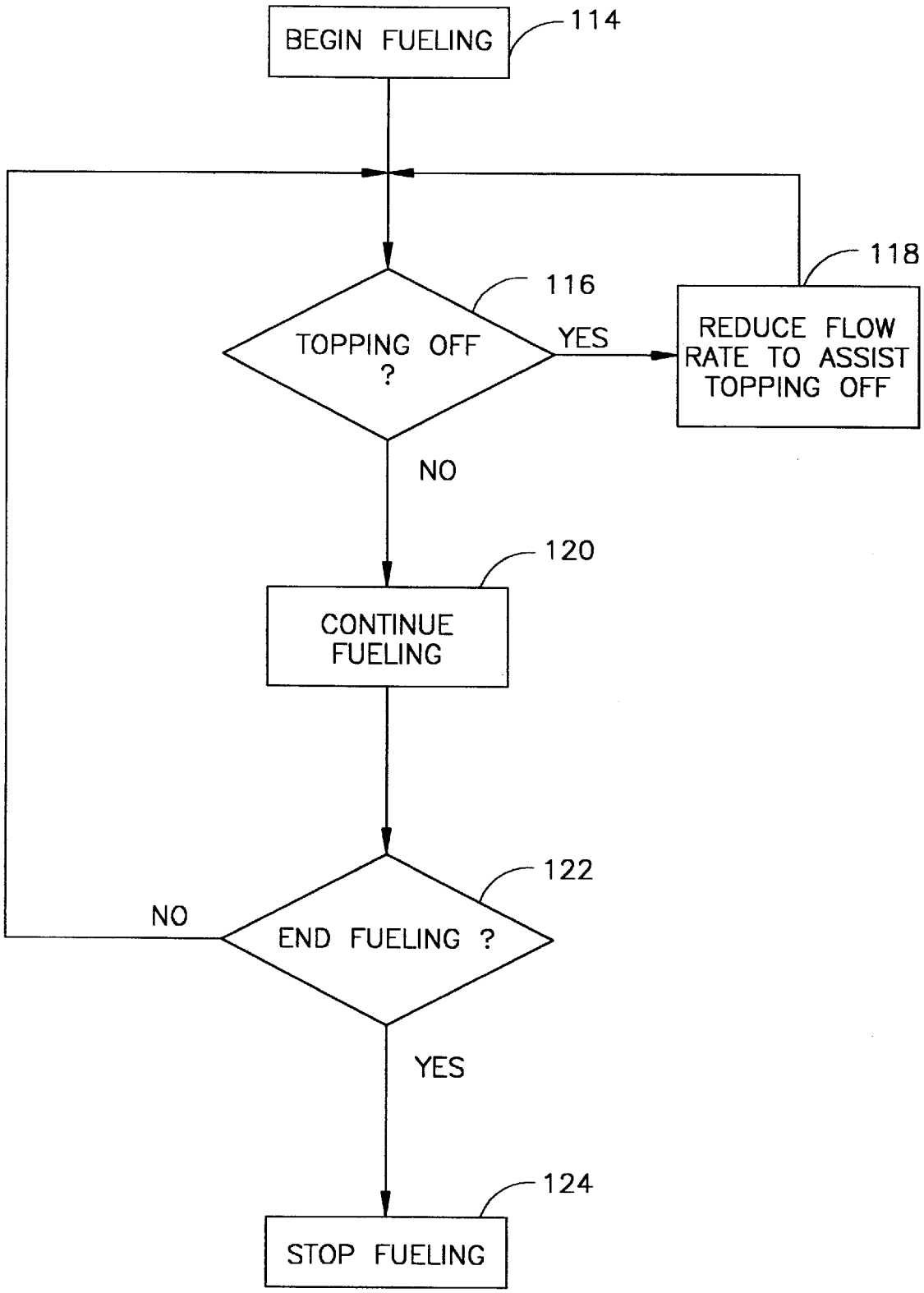
FIG. 10 is a flow chart depicting a control process for controlled topping off according to one embodiment of the current invention.

Equally important as optimizing the delivery of fuel during a fueling operation is minimizing the amount of fuel spilled during the operation. The enhanced control over the fueling operation provided by the current invention minimizes the amount of fuel spilled by controlling flow rates in a manner reducing the possibility of fuel spills. FIG. 10 is a flow chart depicting a control process for assisting a user in topping off a fueling operation in a manner minimizing the potential for spilling fuel. The fueling operation begins at block 114. Nearing the end of the fueling operation, the control system 26 determines whether or not the user is at or near a topping off point in the fueling operation. The system may recognize that the topping off point is near at decision block 116 when automatic shutoffs begin to occur, a pre-set sale or amount is being reached, or the fuel dispenser has received information from the operator or vehicle regarding the amount of fuel necessary to fill the tank. If a topping off point in the fueling operation occurs, the control system 26 reduces the flow rate in a manner assisting topping off and minimizing the potential for spilling fuel at decision block 118 and returns to decision block 116. If the system is not near the topping off point, the control system 26 continues fueling at block 120. The control system 26 subsequently determines whether the fueling operation is at an end at block 122. If the fueling operation is at an end, fueling is stopped at block 124. If the fueling operation is not at an end, the control system 26 returns to decision block 116 in an iterative manner. By reducing the flow rate to zero in a controlled fashion, the slow, spill prone, manual topping off method currently used will be replaced by a quicker and safer fueling operation.

Figure 11:
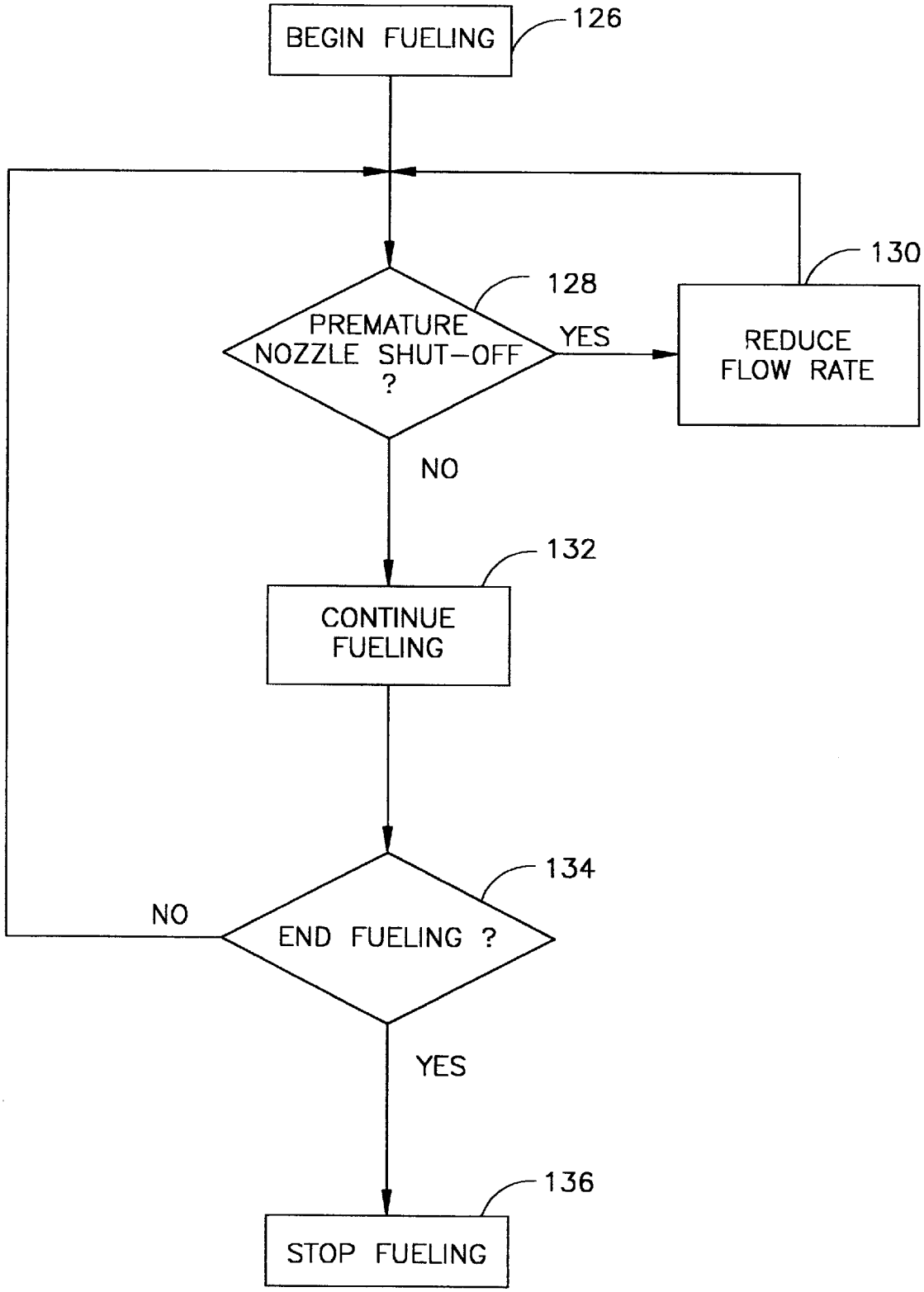
FIG. 11 is a flow chart depicting a control process for reducing flow rates in response to a premature nozzle shutoff according to one embodiment of the current invention.
Figure 12:
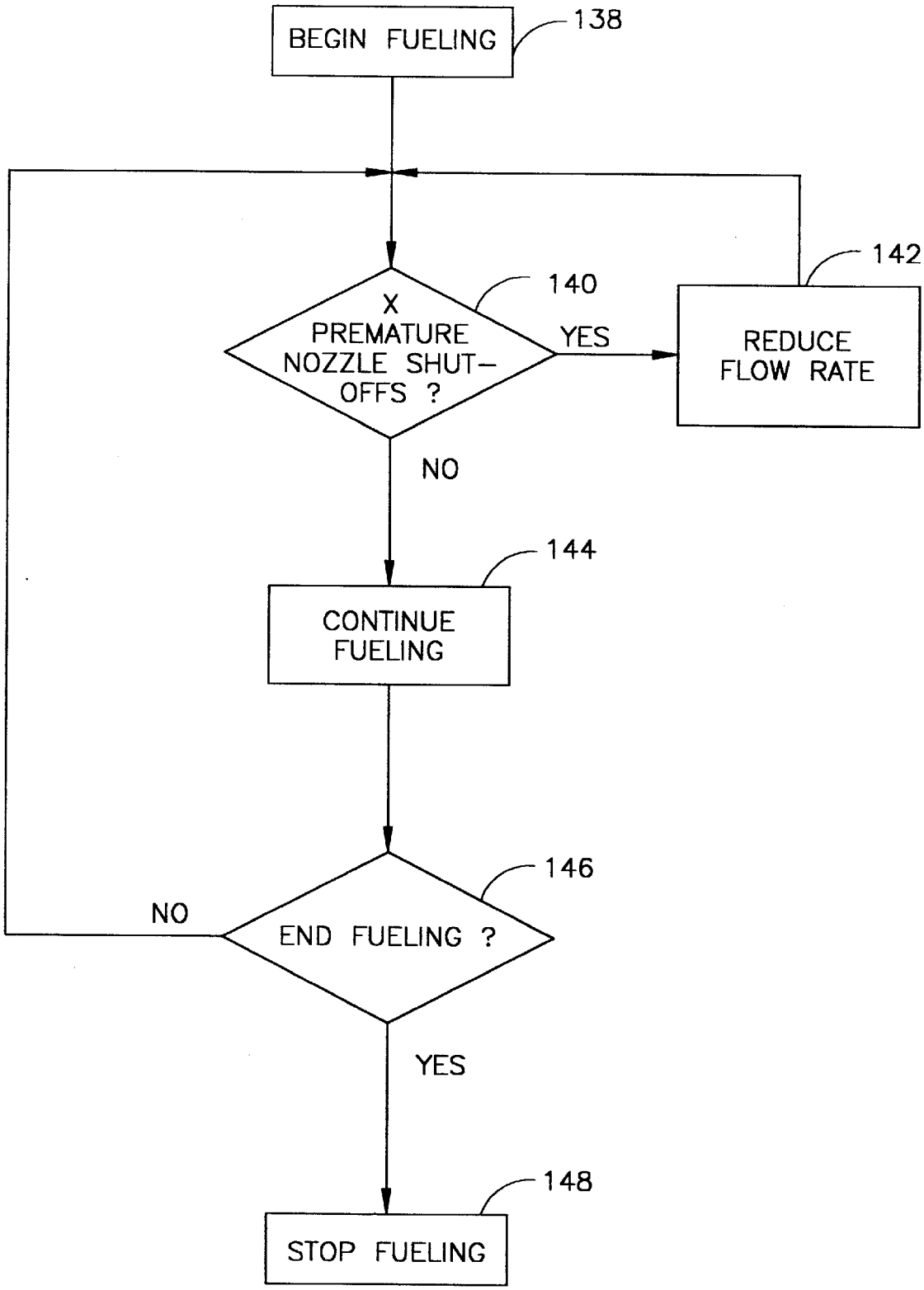
FIG. 12 is a flow chart depicting a control process for controlling flow rates in response to a certain number of premature nozzle shutoffs according to one embodiment of the current invention.
Figure 13:
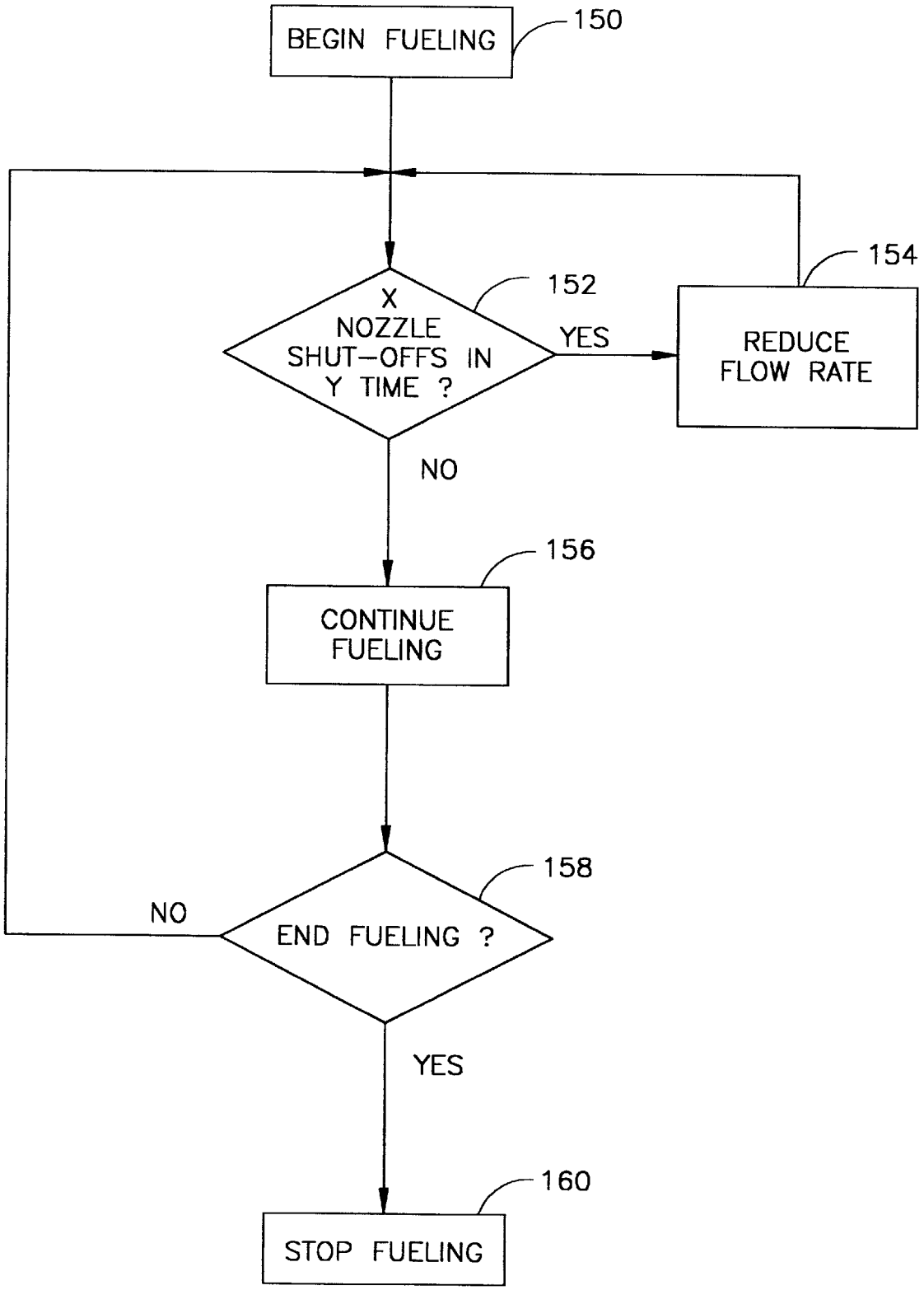
FIG. 13 is a flow chart depicting a control process for reducing flow rates in response to a certain number of nozzle shutoffs during a predetermined period of time according to one embodiment of the current invention.

FIGS. 11–13 depict a control process for reducing flow rates when one or more premature nozzle shutoffs occur in sequence or during a predetermined period of time. In FIG. 11, the fueling operation begins at block 126. The control system 26 determines whether a premature nozzle shutoff has occurred at decision block 128. If a shutoff has occurred, the flow rate is reduced in a manner minimizing the potential for spilling fuel, yet attempting to optimize the fueling operation at block 130. The control system 26 returns to decision block 128 in an iterative manner. If there is no premature nozzle shutoff, the fueling operation is continued at block 132 until the fueling operation reaches an end. The control system 26 determines whether the fueling operation reaches an end at decision block 134. If the fueling operation is at an end, fueling is stopped at block 136. If the fueling operation is not at an end, the control system 26 returns to decision block 128 in an iterative manner.

In FIG. 12, the fueling operation begins at block 138. The control system 26 determines whether a certain number of premature nozzle shutoffs have occurred at decision block 140. If such a number has occurred, the flow rate is reduced accordingly at block 142 and the control system 26 returns to decision block 140 in an iterative manner. If the certain number of premature nozzle shutoffs have not occurred, fueling is continued at block 144 and the control system looks for an end to the fueling operation at decision block 146. If the fueling operation is at an end, fueling is stopped at block 148. If the fueling operation is not at an end, the control system 26 returns to decision block 140 in an iterative manner.

A further refinement of the control process of FIG. 12 is that of FIG. 13. The fueling operation begins at block 150. The control system 26 determines whether a certain number of nozzle shutoffs occur within a predetermined period of time at decision block 152. If such condition occurs, the flow rate is reduced accordingly to minimize fuel spillage while optimizing the fueling operation at block 154. Once the flow rate is reduced, the control system 26 returns to decision block 152 in an iterative manner. If the nozzle shutoff condition is not satisfied, the control system 26 continues fueling at block 156 and looks for an end to the fueling operation at decision block 158. If the fueling operation is at an end, fueling is stopped at block 160. If the fueling condition is not at an end, the control system 26 returns to decision block 152 in an iterative manner.

Figure 14:
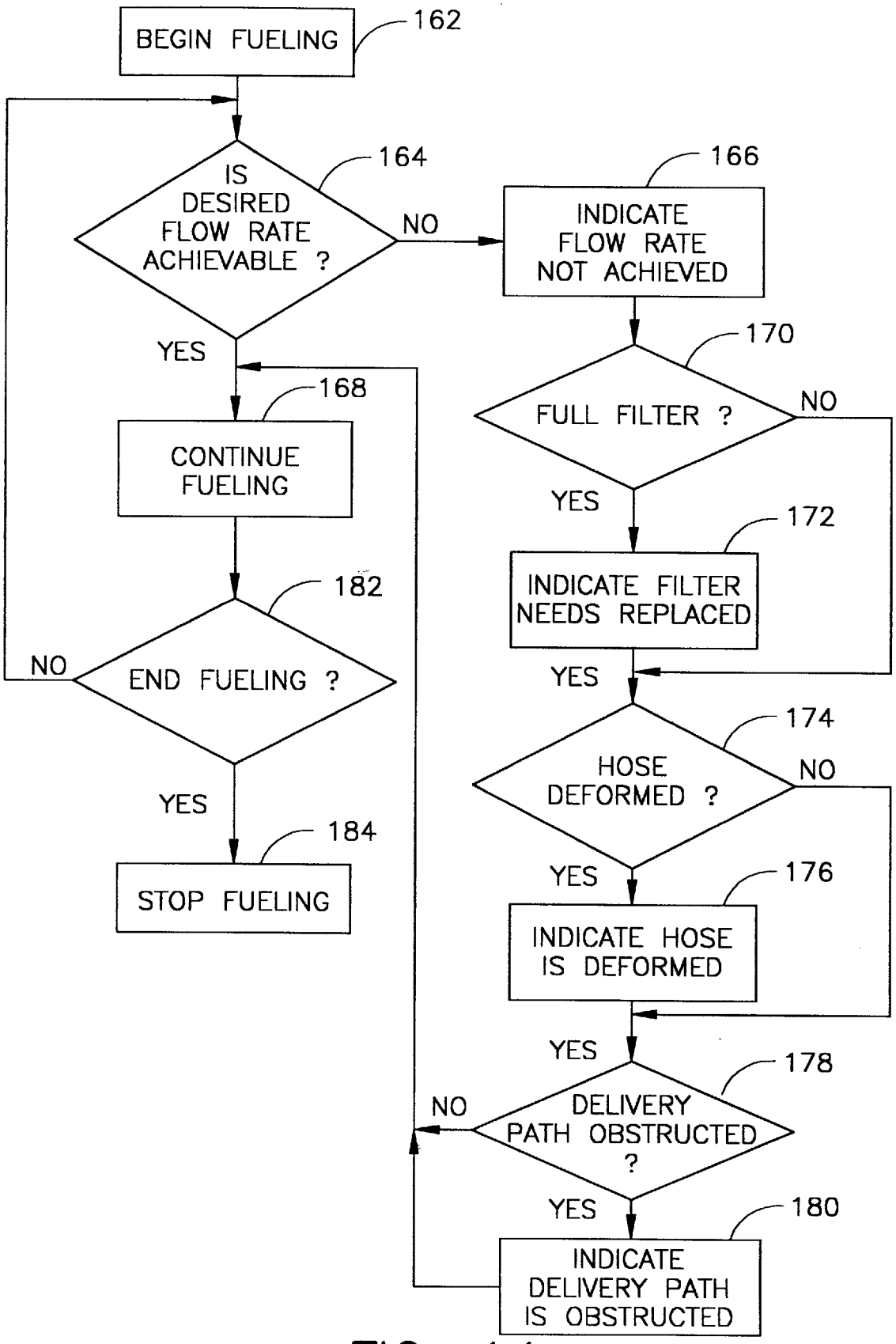
FIG. 14 is a flow chart depicting a control process for indicating a flow rate is not achievable according to one embodiment of the current invention.

Another advantage of the current invention is the ability to provide various warnings or indications of problems associated with the delivery path. Among other indications, the current system may be configured to indicate when a certain flow rate is not achieved or unachievable, the fuel filter is clogged or needs replaced, a delivery hose is deformed, or the delivery path is otherwise obstructed. FIG. 14 depicts a basic control process allowing the control system 26 to indicate when one or more of the above-mentioned problems arise during a fueling operation. The fueling operation begins at block 162. The control system 26 determines whether or not the desired flow rate is achievable at decision block 164. If the desired flow rate is unachievable, the control system 26 indicates that the flow rate is not achieved at block 166. The control system next attempts to determine whether the filter is causing the reduced flow rates at decision block 170. If the filter is the problem, the control system 26 indicates that the filter needs attention at block 172. The control system 26 next determines whether or not the reduced flow rates are caused by a deformed or kinked delivery hose at decision block 174. The control system 26 will also progress to decision block 174 if the fuel filter is not causing reduced flow.

If a hose is deformed, the control system 26 indicates this at block 176 and proceeds to determine whether or not the delivery path is otherwise obstructed at decision block 178. The control system 26 also progresses to decision block 178 after a determination that the delivery hose is not causing the reduced flow. If the delivery path is otherwise obstructed, the control system 26 will indicate so at block 180 and continue fueling at block 168. If the delivery path is not otherwise obstructed, the control system 26 will continue fueling at block 168.

If the desired flow rate is achievable, as determined at decision block 164, the control system 26 will continue fueling at block 168. At this point, the control system 26 determines whether the fueling operation is at an end at decision block 182. If the fueling operation is at an end, fueling is stopped at block 184. If the fueling operation is not at an end, the control system 26 returns to decision block 164 in an iterative manner, further checking delivery rates.

OPERATION USING RECEIVED VEHICLE DATA

Figure 15:
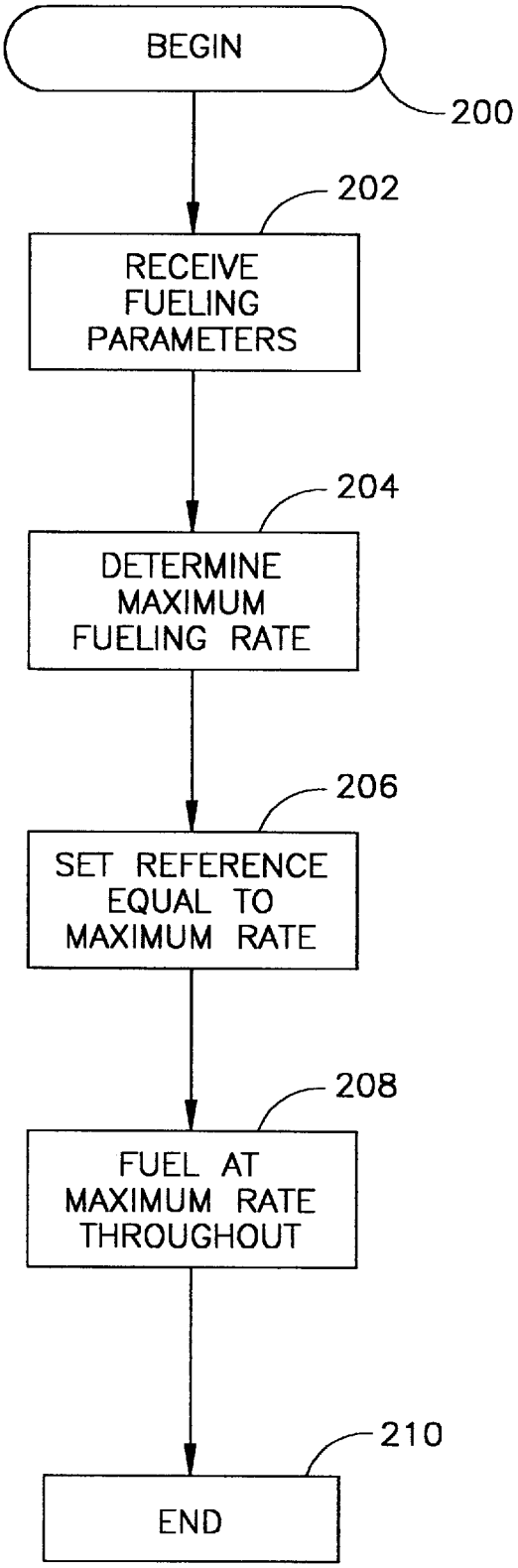
FIG. 15 is a flow chart depicting a control process for delivering fuel at a set, maximum fueling rate based on fueling parameters received from the vehicle.

The desired flow rate (or reference) is controlled as desired for each fueling operation. FIG. 15 depicts a control process for determining a maximum, set flow rate for all or a portion of the fueling operation. The process begins at block 200 and receives fueling parameters from the vehicle at block 202. From the fueling parameters, the control system 26 determines the maximum flow rate to be used for most of the fueling operation at block 204. The reference is set to the determined maximum fueling rate at block 206. Accordingly, the control system 26 controls the dispenser to fuel at the maximum rate throughout the fueling process at block 208 until the fueling operation is over at block 210.

Figure 16:
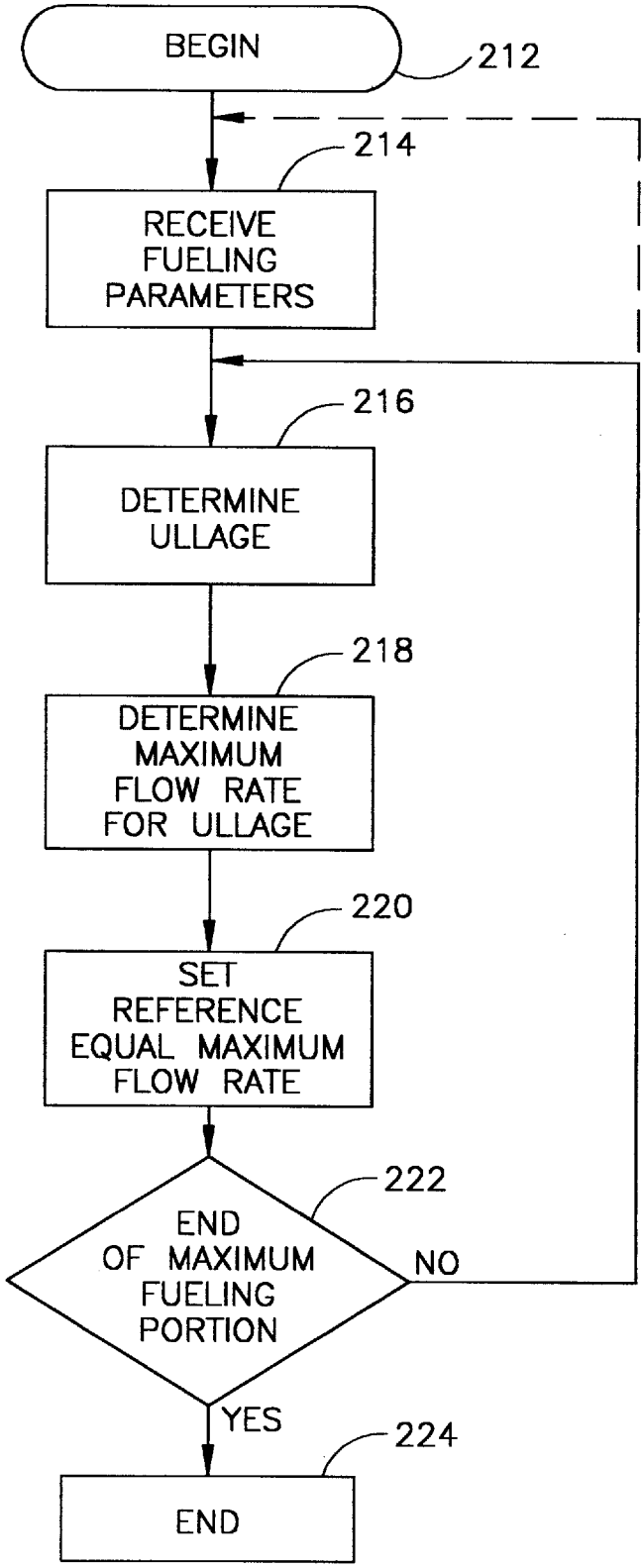
FIG. 16 is a flow chart depicting a control process for fueling at a maximum flow rate as a function of ullage based on fueling parameters received from the vehicle.

The control process of FIG. 16 continuously adjusts the maximum fueling rate as a function of ullage. The process begins at block 212 and receives fueling parameters from the vehicle at block 214. Preferably, ullage is determined at block 216 and the maximum flow rate for that particular ullage is determined at block 218. Controlling the fueling as a function of ullage depends on receiving parameters from the vehicle providing this information or information which allows the control system 26 to calculate fueling rates for various ullage values. The vehicle may provide the ullage information directly or information sufficient for the dispenser to calculate or look up ullage or other information in a database having information related to the vehicle's make and model. Once the maximum flow rate is determined for a particular ullage value, the reference is set equal to the determined maximum flow rate at block 220. The control system 26 will continuously monitor for the end of the maximum fueling portion at block 222. If the end of the maximum fueling portion is reached, the process ends at block 224. If the maximum fueling portion is not near an end, the process loops back to a portion of the program determining ullage. The control system 26 may receive the updated ullage values from additional fueling parameters from the vehicle 100 or may calculate new ullage values based on the original ullage value at the beginning of the fueling operation less the amount of fuel delivered since the beginning of fueling operation.

Figure 17:
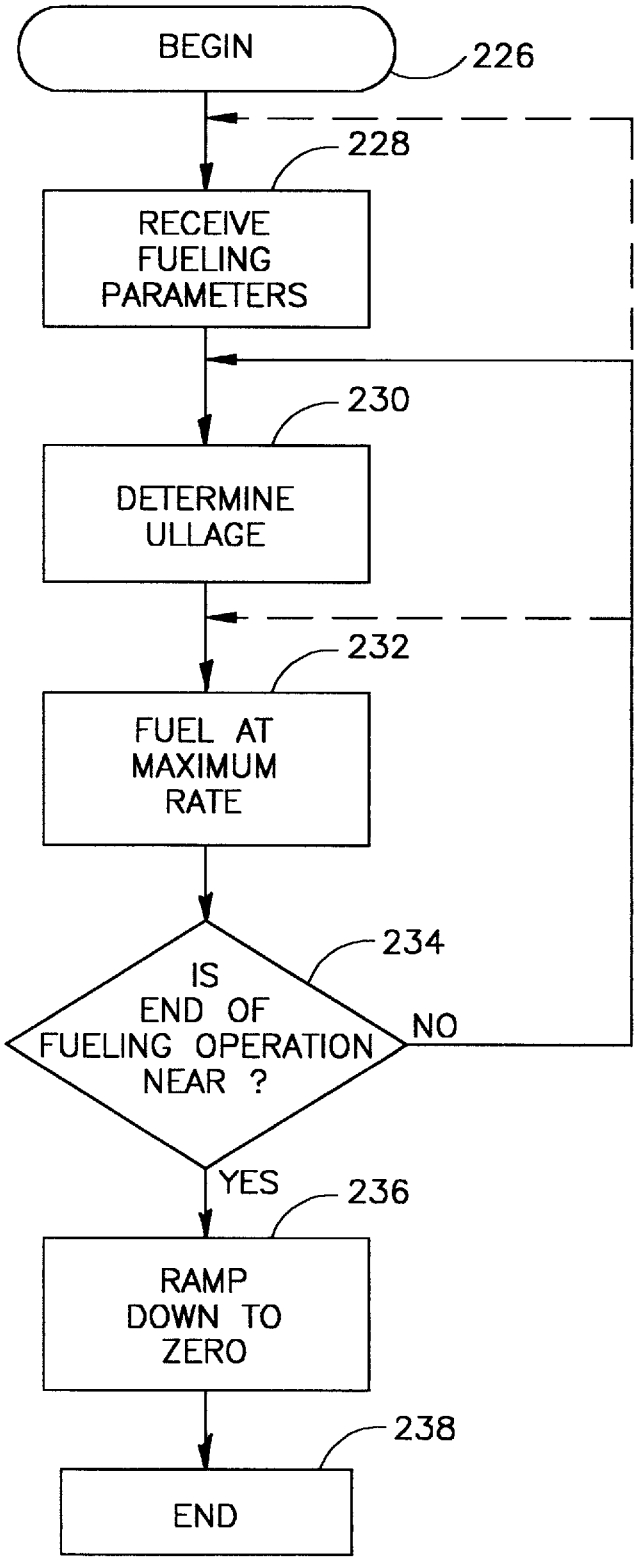
FIG. 17 is a flow chart depicting a control process for fueling a vehicle at a maximum fueling rate and ramping down the fueling rate near the end of the fueling operation based on fueling parameters received from the vehicle.

The fueling process of FIG. 17 is exemplary of combining fueling parameters received from the vehicle 100 and parameters known by the dispenser in order to optimize fueling and minimize fuel spillage. The process begins at block 226 and fueling parameters are received at block 228. The ullage value is determined at 230 and the maximum fueling rate for the entire fueling operation or for a specific ullage value is determined at block 232. The control system 26 determines whether the fueling operation is near an end based on additional fueling parameters from the vehicle 100 or on the original ullage value and the amount of fuel delivered since the beginning of the fueling operation at block 234. If the fueling operation is not near an end, the process loops back to determine a new ullage value at block 232 or by receiving additional fueling parameters from the vehicle at block 228. Optionally, the control system 26 could fuel at a set maximum rate for substantially all of the fueling operation and loop back to block 232. If the fueling operation is near an end, the control system 26 continuously adjusts the reference value down to zero in manner minimizing spillage yet maximizing flow rates in order to minimize the length of time required to fuel the vehicle 100. Once the fuel rate is ramped down to zero at block 236, the process ends at block 238. Similarly, the operation may include ramping up to a maximum fueling rates and minimize surge or spillage according to parameters defined by the dispenser prior to operating at parameters based on information received from the vehicle 100.

Figure 18:
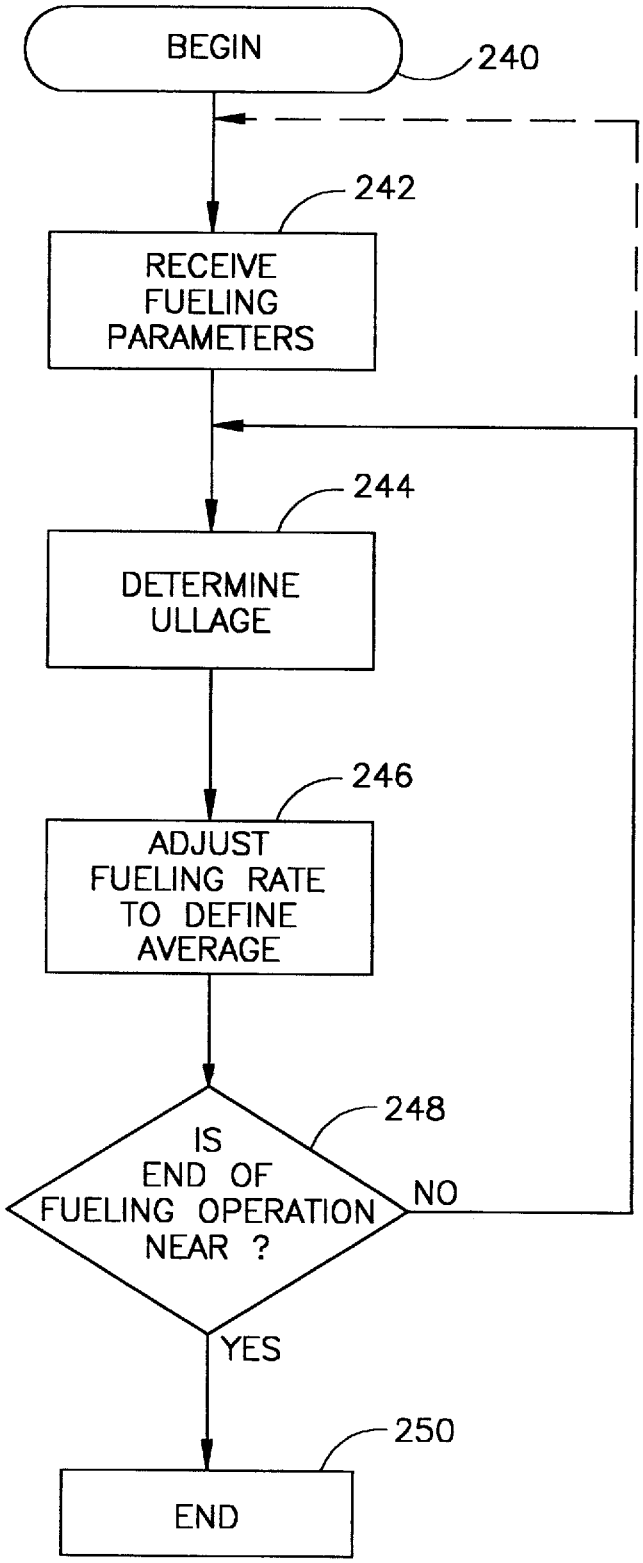
FIG. 18 is a flow chart depicting a control process for providing a defined average fueling rate over a portion or the entire fueling operation based on parameters received from a vehicle.

The control process of FIG. 18 provides a fueling operation wherein the flow rate during all or a portion of the fueling operation is adjusted to a predefined average. The process begins at block 240 where fueling parameters are received from the vehicle at block 242. Ullage is determined at block 244 and the fueling rate is determined to provide a predefined average at block 246. The average may be determined in numerous ways. For example, the control system 26 may determine ullage values and the amount of fuel required to fill the vehicle's fuel tank and provide instantaneous flow rate adjustments throughout the fueling process to obtain the predefined average. Optionally, the control system 26 may calculate the amount of fuel required to fill the vehicle's fuel tank and determine a fueling schedule for the entire fueling operation which will provide an average fuel rate for the overall fueling operation or a portion thereof. Typically, the control system 26 will monitor for the end of the fueling operation at block 248. If the end of the fueling operation is not near, the process will loop back to determine ullage values as desired. If the operation is near end, the process ends at block 250 or goes into a ramp down routine to minimize spillage.

Figure 19:
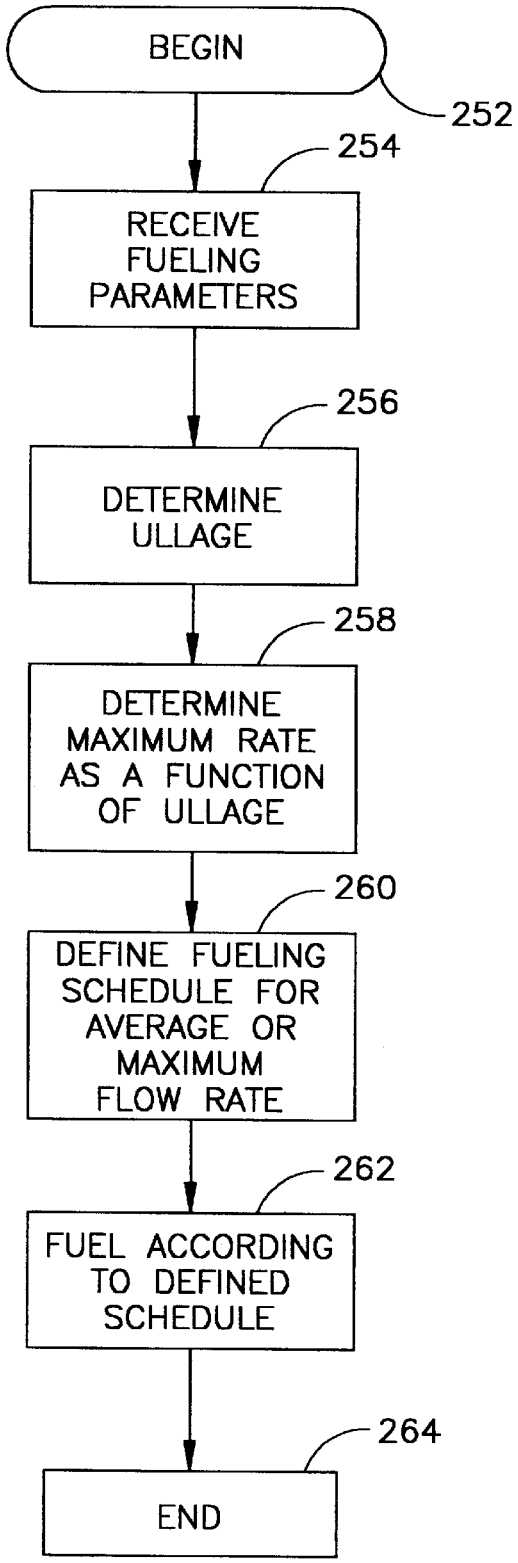
FIG. 19 is a flow chart depicting a control process for providing a fueling schedule for a portion of or the entire fueling operation wherein fueling rates are maximized based on fueling parameters received from a vehicle.

The control process of FIG. 19 determines a defined fueling schedule for the entire fueling operation or a portion thereof based on parameters received from the vehicle. The process begins at block 252 and the control system 26 receives fueling parameters from the vehicle at block 254. Ullage values are determined at block 256 and preferably, the maximum fueling rate as a function of ullage is determined at block 258. Based on these parameters, the control system 26 determines a fueling schedule for the entire fueling operation or a portion thereof to optimize fueling at block 260. The schedule may attempt to maximize flow rates throughout the entire fueling operation or a portion thereof or provide an overall average flow rate. Once the schedule is defined, the control system 26 controls the fueling operation according to the defined schedule at 262 and ends the operation at 264. Preferably, the ramping up and down of the fueling rates at the beginning and end of the fueling operation is controlled according to the fueling schedule to provide the desired flow rate in addition to minimizing fuel surge and spillage.

Notably, the control system 26 may control the fueling operation to maximize the fueling operation as described above while taking into consideration regulatory mandates or vehicle limitations. For example, fueling processes where the control system 26 attempts to continuously maximize flow rates throughout the entire operation will also take into consideration any maximum instantaneous or average flow rate limitations imposed by the dispenser, vehicle, site or regulatory agency. In short, applicants' invention optimizes fueling while minimizing spillage, all while staying within physical and regulatory limitations.

Those of ordinary skill in the art will realize that the various functions and embodiments discussed may be modified and combined in numerous ways, all of which are deemed within the scope of the applicants' invention. Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. An intelligent, precision fuel dispenser comprising:

a fuel dispenser for delivering fuel along a fuel delivery path to a vehicle;

a receiver adapted to remotely receive ullage related fueling parameters from the vehicle to be fueled;

flow rate control hardware for controlling the flow rate of fuel to the vehicle during a fueling operation; and a control system operatively associated with said receiver and said flow rate control hardware for regulating the fuel flow rate in said fuel delivery path during at least a portion of fuel delivery for the fueling operation based on the ullage related fueling parameters received from the vehicle.

2. The intelligent, precision fuel dispenser of claim 1 wherein the received ullage related fueling parameters relate to a defined allowable fuel delivery rate for the vehicle and said control system regulates the fuel flow rate in said delivery path to the defined fuel delivery rate during the portion of fuel delivery.

3. The intelligent, precision fuel dispenser of claim 2 wherein the defined fuel delivery rate changes with changes in ullage and said control system continuously adjusts the fuel flow rate to the defined fuel delivery rate throughout the portion of fuel delivery based on changes in ullage.

4. The intelligent, precision fuel dispenser of claim 1 wherein the ullage related fueling parameters received from the vehicle relate to a starting ullage for the vehicle and said control system controls the fuel flow rate during the portion of fuel delivery based on the starting ullage.

5. The intelligent, precision fuel dispenser of claim 4 wherein the received fueling parameters further relate to maximum flow rate as a function of ullage and said control system regulates the fuel flow rate to a maximum allowable fuel rate as a function of fuel tank ullage.

6. The intelligent, precision fuel dispenser of claim 1 wherein the received ullage related fueling parameters further relate to maximum flow rate as a function of ullage and said control system regulates the fuel flow rate to a maximum allowable fuel rate as a function of fuel tank ullage.

7. The intelligent, precision fuel dispenser of claim 1 wherein said control system regulates the fuel flow rate to a predefined average flow rate during the portion of the fueling operation based on the ullage related fueling parameters received from the vehicle.

8. The intelligent, precision fuel dispenser of claim 1 wherein said control system determines an amount of fuel required to fill the vehicle's tank based on the ullage related fueling parameters received from the vehicle, determines a fueling schedule to provide the predefined fuel flow rates and regulates fuel flow rates throughout the portion of fuel delivery according to said schedule.

9. The intelligent, precision fuel dispenser of claim 1 wherein said control system ramps up the fuel flow rate while minimizing spillage at a beginning of the fueling operation to a desired fuel flow rate based on the ullage related fueling parameters received from the vehicle.

10. The intelligent, precision fuel dispenser of claim 1 wherein said control system ramps down the fuel flow rate while minimizing spillage at an end of the fueling operation from a desired fuel flow rate based on the ullage related fueling parameters received from the vehicle.

11. The intelligent, precision fuel dispenser of claim 1 wherein said control system ramps up the fuel flow rate while minimizing spillage at a beginning of the fueling operation and ramps down the fuel flow rate, while minimizing spillage at an end of the fueling operation, to a maximum allowable fuel flow rate based on the fueling parameters received from the vehicle.

12. The intelligent, precision fuel dispenser of claim 11 wherein said control system between ramping up at the beginning and ramping down at the end of the fueling operation adjusts the fuel flow rate to a maximum allowable fuel flow rate.

13. The intelligent, precision fuel dispenser of claim 12 wherein said control system continuously adjusts fuel flow rate to a maximum allowable fuel flow rate as a function of fuel tank ullage.

14. The intelligent, precision fuel dispenser of claim 12 wherein said control system continuously adjusts fuel flow rate to a maximum allowable fuel flow rate as a function of regulatory mandate.

15. The intelligent, precision fuel dispenser of claim 11 wherein, said control system between ramping up at the beginning and ramping down at the end of the fueling operation regulates the fuel flow rate to a predefined average flow rate based on the parameters received from the vehicle.

16. The intelligent, precision fuel dispenser of claim 11 wherein, said control system between ramping up at the beginning and ramping down at the end of the fueling operation regulates the fuel flow rate to a predefined average flow rate based on fuel tank ullage parameters received from the vehicle.

17. The intelligent, precision fuel dispenser of claim 1 wherein the dispenser further includes a vapor recovery system operatively associated with said control system and the dispenser further receives information relating to the presence of an onboard vapor recovery system on the vehicle, said control system adapted to control the vapor recovery system according to the information relating to the presence of an onboard vapor recovery system.

18. The intelligent, precision fuel dispenser of claim 1 wherein said control system interrogates a vehicle transponder for the ullage related fueling parameters.

19. The intelligent, precision fuel dispenser of claim 1 wherein said control system interrogates a vehicle transponder for information relating to said vehicle.

20. A fuel dispenser comprising a fuel delivery system adapted to control fuel flow rate and a receiver associated with said delivery system adapted to receive signals from a vehicle including ullage related fueling parameters for the vehicle, said delivery system controlling fuel delivery rate for at least a portion of fuel delivery during a fueling operation based on the ullage related fueling parameters received from the vehicle.

21. The fuel dispenser of claim 20 wherein the fueling parameters relate to an initial tank ullage of the vehicle and the delivery system regulates fuel flow rate during the portion of fuel delivery based on the initial tank ullage.

22. The fuel dispenser of claim 20 wherein the ullage related fueling parameters further relate to a defined fuel flow rate as a function of tank ullage and the delivery system adjusts the fuel flow rate during the portion of fuel delivery to the defined flow rate as a function of tank ullage.

23. The fuel dispenser of claim 20 wherein the ullage related fueling parameters relate to an initial tank ullage of the vehicle and the delivery system determines a fueling schedule for at least a portion of fuel delivery based on the initial tank ullage and regulates fuel flow according to said schedule.

24. The fuel dispenser of claim 23 wherein the receiver periodically receives ullage related fueling parameters from the vehicle and said delivery system regulates fuel flow according to said schedule based on the ullage related fueling parameters.

25. The fuel dispenser of claim 23 wherein the delivery system updates ullage information based on an amount of fuel delivered and regulates fuel flow according to said schedule based on the ullage related fueling parameters.

26. The fuel dispenser of claim 20 where said fuel delivery system comprises:

a fuel delivery path;

a flow rate modulator in said fuel delivery path; and said control system is operatively associated with said flow rate modulator for regulating the rate of flow in said fuel delivery path during a portion of a fueling operation.

27. The fuel dispenser of claim 26 further comprising a flow transducer in said fuel delivery path configured to provide a flow transducer signal representing a volume of fuel flow in said fuel delivery path to said control system.

28. The precision fuel dispenser of claim 27 wherein said control system is adapted to derive a forcing function from differences between an actual flow rate determined from said flow transducer signal and a desired flow rate, said control system regulates the rate of flow in said fuel delivery path according to said forcing function.

29. The precision fuel dispenser of claim 27 wherein said control system is configured to indicate when a certain rate of flow is not achievable.

30. The precision fuel dispenser of claim 27 wherein said control system is configured to indicate when fuel flow is inhibited.

31. The precision fuel dispenser of claim 27 wherein said control system is configured to indicate when a filter needs to be replaced, a delivery hose is deformed or said delivery path is otherwise obstructed.

32. The precision fuel dispenser of claim 27 wherein said flow rate transducer includes a flow meter and said transducer signals include volumetric pulses to said control system.

33. The precision fuel dispenser of claim 26 wherein said control system has a reference flow rate representing a desired flow rate and said control system is adapted to regulate the rate of flow in said fuel delivery path to achieve said reference flow rate.

34. The precision fuel dispenser of claim 26 wherein said control system is configured to ramp up the rate of flow in said delivery path from a lower rate of flow.

35. The precision fuel dispenser of claim 26 wherein said control system is configured to ramp down the rate of flow in said delivery path from a higher rate of flow.

36. The precision fuel dispenser of claim 26 wherein said control system is configured to control the rate of flow in said delivery path to provide a predetermined average rate of flow during a portion of the fueling operation.

37. The precision fuel dispenser of claim 26 wherein said control system is configured to control the rate of flow in said delivery path to provide a predetermined average rate of flow during a most of the fueling operation.

38. The precision fuel dispenser of claim 26 wherein said control system is configured to control the rate of flow in said delivery path to provide a predetermined rate of flow under varying dynamic conditions.

39. The precision fuel dispenser of claim 26 wherein said control system is configured to control the rate of flow in said delivery path to provide a predetermined average rate of flow under varying dynamic conditions.

40. The precision fuel dispenser of claim 26 wherein said control system is configured to control the rate of flow in said delivery path to provide a reduced rate of flow after a premature automatic shut-off.

41. The precision fuel dispenser of claim 26 wherein said control system is configured to control the rate of flow in said delivery path to assist in topping off a fueling operation.

42. The precision fuel dispenser of claim 26 wherein said control system is configured to control the rate of flow in said delivery path to provide a reduced rate of flow when a predetermined number of automatic shut-offs occur.

43. The precision fuel dispenser of claim 26 wherein said control system is configured to control the rate of flow in said delivery path to provide a reduced rate of flow when a predetermined number of automatic shut-offs occur within a predetermined period of time.

44. The precision fuel dispenser of claim 26 wherein said control system is configured to control the rate of flow in said delivery path to compensate for deteriorating components which affect the flow rate.

45. The precision fuel dispenser of claim 26 wherein said flow rate modulator comprises a flow control valve.

46. The fuel dispenser of claim 20 wherein said receiver is adapted to receive RF signals from the vehicle.

47. A method of controlling fuel delivery comprising:

providing a fuel dispenser having a receiver adapted to remotely receive ullage related fueling parameters from a vehicle;

receiving the ullage related fueling parameters from the vehicle at a fuel dispenser during a fueling operation;

initializing the fuel dispenser for fuel delivery; and controlling fuel delivery, during at least a portion of fuel delivery, to the vehicle based on the received ullage related fueling parameters.

48. The method of controlling fuel delivery of claim 47 wherein the step of controlling fuel delivery rate further comprises regulating the fuel flow rate in the delivery path to a defined fuel delivery rate during a portion of the fueling operation.

49. The method of controlling fuel delivery of claim 42 wherein the step of controlling fuel delivery further comprises optimizing the fueling operation based on the fueling parameters received from the vehicle while minimizing fuel spillage.

50. The method of controlling fuel delivery of claim 47 further comprising adjusting the fuel delivery rate to a maximum allowable delivery rate based on the ullage related fueling parameters during a portion of the fueling operation.

51. The method of controlling fuel delivery of claim 47 further comprising continuously adjusting the fuel delivery rate as necessary to a defined fuel delivery rate based on the ullage related information throughout the portion of the fueling operation.

52. The method of controlling fuel delivery of claim 47 further comprising:

receiving a fueling parameter relating to the vehicle's maximum allowable fuel delivery rate as a function fuel tank ullage and adjusting the fuel delivery rate to a maximum allowable delivery rate as a function of fuel tank ullage.

53. The method of controlling fuel delivery of claim 47 further comprising:

determining a predefined average fuel delivery rate for the portion of the fueling operation, and adjusting the fuel delivery rate during the fueling operation to provide the predefined average fuel delivery rate for the portion of the fueling operation.

54. The method of controlling fuel delivery of claim 47 further comprising:

determining a fueling schedule for the portion of fuel delivery, and controlling the fuel delivery rate during the fueling operation according to said schedule.

55. The method of controlling fuel delivery of claim 47 wherein the step of controlling fuel delivery comprises ramping up the fuel delivery rate to a maximum allowable fuel delivery rate while minimizing spillage at a beginning of the fueling operation.

56. The method of controlling fuel delivery of claim 47 wherein the step of controlling fuel delivery comprises ramping down the fuel delivery rate from a maximum allowable fuel delivery rate while minimizing spillage at an end of the fueling operation.

57. The method of controlling fuel delivery of claim 47 wherein the step of controlling fuel delivery comprises ramping up the fuel delivery rate to a maximum allowable fuel delivery rate while minimizing spillage at a beginning of the fueling operation; ramping down the fuel delivery rate from the maximum allowable fuel delivery rate while minimizing spillage at an end of the fueling operation and continuously adjusting the fuel delivery rate to a maximum allowable fuel delivery rate as necessary between the ramping steps.

58. The method of controlling fuel delivery of claim 47 wherein the step of controlling fuel delivery comprises ramping up the fuel delivery rate to a maximum allowable fuel delivery rate while minimizing spillage at a beginning of the fueling operation; ramping down the fuel delivery rate from the maximum allowable fuel delivery rate while minimizing spillage at an end of the fueling operation and adjusting the fuel delivery rate to obtain a predefined average delivery rate between the ramping steps.

59. A fuel dispenser comprising:

a fuel dispenser for delivering fuel along a fuel delivery path;

a receiver adapted to remotely receive a vehicle fueling parameter from a vehicle to be fueled, the parameter bearing on fuel delivery flow rates for the vehicle during at least a portion of fuel delivery;

means for controlling the flow rate of fuel to the vehicle during a fueling operation; and a control system operatively associated with said receiver and said means for controlling the flow rate, said control system adapted to regulate the fuel delivery flow rate during the portion of fueling based on the parameter relating to fuel delivery rate received from the vehicle;

wherein the parameter relates to fuel tank ullage and said control system is configured to regulate the fuel delivery flow rate during the portion of fuel delivery based on the fuel tank ullage.

60. The fuel dispenser of claim 59 wherein the parameter relates to an initial fuel tank ullage and said control system is configured to regulate the fuel delivery flow rate during the portion of fuel delivery based on the initial fuel tank ullage.

61. The fuel dispenser of claim 59 wherein said control system is configured to regulate the fuel delivery flow rate as a function of ullage during the portion of fuel delivery.

62. The fuel dispenser of claim 59 wherein the parameter further includes information relating to vehicle configuration, and said control system is configured to regulate the fuel delivery flow rate based on the ullage related information and vehicle configuration during the portion of fuel delivery.

63. The fuel dispenser of claim 59 wherein the parameter further includes information relating to vehicle configuration, and said control system is configured to regulate the fuel delivery flow rate based on the vehicle configuration during the portion of fuel delivery.

64. The fuel dispenser of claim 63 wherein the vehicle configuration relates to a vehicle fuel tank configuration, and said control system is configured to regulate the fuel delivery flow rate based on the vehicle fuel tank configuration the portion of fuel delivery.

65. A fuel dispenser comprising:

a fuel dispenser for delivering fuel along a fuel delivery path;

a receiver adapted to remotely receive a vehicle fueling parameter from a vehicle to be fueled, the parameter bearing on fuel delivery flow rates for the vehicle during at least a portion of fuel delivery;

means for controlling the flow rate of fuel to the vehicle during a fueling operation; and a control system operatively associated with said receiver and said means for controlling the flow rate, said control system adapted to regulate the fuel delivery flow rate during the portion of fueling based on the parameter relating to fuel delivery rate received from the vehicle;

wherein the parameter relates to fuel tank ullage and said control system is configured to regulate the fuel delivery flow rate during the portion of fuel delivery based on the fuel tank ullage, and said control system is configured to regulate the fuel delivery flow rate at a constant flow rate during the portion of fuel delivery.

66. A fuel dispenser comprising:

a fuel dispenser for delivering fuel along a fuel delivery path;

a receiver adapted to remotely receive a vehicle fueling parameter from a vehicle to be fueled, the parameter bearing on fuel delivery flow rates for the vehicle during at least a portion of fuel delivery;

means for controlling the flow rate of fuel to the vehicle during a fueling operation; and a control system operatively associated with said receiver and said means for controlling the flow rate, said control system adapted to regulate the fuel delivery flow rate during the portion of fueling based on the parameter relating to fuel delivery rate received from the vehicle;

wherein the parameter relates to fuel tank ullage and said control system is configured to regulate the fuel delivery flow rate during the portion of fuel delivery based on the fuel tank ullage, and said control system is configured to regulate the fuel delivery flow rate according to a determined fueling schedule during the portion of fuel delivery.

* * * * *